US007275667B2

(12) United States Patent
Bertucci

(10) Patent No.: US 7,275,667 B2
(45) Date of Patent: Oct. 2, 2007

(54) WATCH BAND CONSTRUCTION

(76) Inventor: Michael H. Bertucci, 991 Charles Ave., Gurnee, IL (US) 60031

( * ) Notice: Subject to any disclaimer, the term of this patent is extended or adjusted under 35 U.S.C. 154(b) by 485 days.

(21) Appl. No.: 10/858,225

(22) Filed: Jun. 1, 2004

(65) Prior Publication Data

US 2004/0245299 A1 Dec. 9, 2004

Related U.S. Application Data

(60) Provisional application No. 60/475,764, filed on Jun. 4, 2003.

(51) Int. Cl.
*A44B 1/04* (2006.01)
*A44B 11/25* (2006.01)

(52) U.S. Cl. ..... 224/178; 224/179; 2/338

(58) Field of Classification Search ..... 224/164–180, 224/219, 222, 267; 2/170, 338, 322; 24/265 WS, 24/178, DIG. 43; D10/32; D11/3
See application file for complete search history.

(56) References Cited

U.S. PATENT DOCUMENTS 1,234,165 A * 7/1917 Hill ..... 2/322
2,420,435 A * 5/1947 Lackow ..... 224/164
2,573,055 A * 10/1951 Pedersen ..... 224/178
2,586,457 A * 2/1952 Epstein ..... 2/322
3,578,208 A * 5/1971 Herzog ..... 224/178
5,212,966 A * 5/1993 Minami ..... 63/3
5,873,133 A * 2/1999 Jurga et al. ..... 2/322
6,108,822 A * 8/2000 Calagui ..... 2/338
6,339,848 B1 * 1/2002 Mayhood et al. ..... 2/338
6,553,633 B1 * 4/2003 Rantala ..... 24/265 WS

* cited by examiner

*Primary Examiner*—Nathan J. Newhouse
*Assistant Examiner*—Corey N Skurdal
(74) *Attorney, Agent, or Firm*—Trexler, Bushnell, Giangiorgi, Blackstone & Marr, Ltd

(57) ABSTRACT

The present invention provides a watch band construction which includes a top layer, a bottom layer and an insert. The top and bottom layers each have an aperture provided proximate to the tip ends thereof. The insert is positioned between the top and bottom layers within the apertures and is stitched to the top and bottom layers to secure the insert between the top and bottom layers. The insert provides the tip for the watch band, as well as the holes through which the buckle prong extends. The tip may be formed with raised portions and the holes may be formed with angled walls at the bottom of the insert. The insert is formed with a curve bias along both a length and width thereof. The insert is formed of a sturdy material, such as resin, such that it is durable and long lasting in the areas of high wear.

27 Claims, 6 Drawing Sheets

202
204
206
208
212
214
216
220
223
224
226
228
230
234
236
238
240
243
244
246
248
251
253
255
256
257
258
259
260
261
263
265
267
269
271
273
275
276
277
278
279
280
281

WATCH BAND CONSTRUCTION

CROSS-REFERENCE

This patent application claims the benefit of domestic priority of U.S. Provisional Application Ser. No. 60/475,764, filed Jun. 4, 2003, and entitled "Watch Band Construction".

BACKGROUND OF THE INVENTION

The present invention relates to a novel construction for a watch band.

Woven materials, such as cloth, fabric, nylon, polyester, cotton, and polypropylene, tend to fray, become loosened, unraveled, or un-woven on all "raw edges" or edges that are cut during the fabrication process in making a finished good. One such finished good on which this typically occurs is a watch band.

The "raw edges" on a watch band are typically the tip end and the holes that are cut for a buckle prong, which are high wear areas. As a user puts on and takes off the watch, the holes and tip become increasingly worn out as the weaker woven material contacts the metal buckle and the buckle prong. This repeated use reduces the durability and life of the watch band. In some cases, as a common practice, a grommet, eyelet, heat welding or other additional parts are added to protect the raw edge, but these remedies stick up above the base material surface such that they can be uncomfortable for the user and can be aesthetically and design limiting. Additionally, these remedies tend to not be very durable themselves.

Thus, there is a need for a watch band construction which overcomes the disadvantages of prior art watch bands. The present invention provides such a watch band construction. Other features and advantages of the present invention will become apparent upon a reading of the attached specification in combination with a study of the drawings.

OBJECTS AND SUMMARY OF THE INVENTION

A primary object of the invention is to provide a watch band construction which is more durable than prior art watch band constructions such that the watch band construction will not wear out as fast as prior art watch band constructions in high wear areas of the watch band, namely the tip end and the holes that are cut for a buckle prong.

Another object of the present invention is to provide a watch band construction which is aesthetically pleasing.

Another object of the present invention is to provide a watch band construction which is not design limiting.

Yet another object of the present invention is to provide a watch band construction with improved durability without sacrificing comfort and styling.

Still another object of the present invention is to provide a watch band construction which allows for the easy insertion of the buckle prong into the holes provided in the watch band.

Briefly, and in accordance with the foregoing, the present invention provides a watch band construction which has high durability without sacrificing comfort and styling. The watch band construction includes a top layer, a bottom layer and an insert. The top layer and the bottom layer each have a die cut aperture provided proximate to the tip ends thereof. The insert is positioned between the top and bottom layers within the die cut apertures and is stitched to the top and bottom layers to secure the insert between the top and bottom layers. The insert provides the tip for the watch band, as well as the holes through which the buckle prong extends, which are the high wear areas of a watch band. The tip may be formed with raised portions to assist the user in gripping the tip. The holes may be formed with an angle at the bottom of the insert in order to facilitate the insertion of the buckle prong into the holes. The insert is formed with a curve bias along both a length and width thereof such that the insert will better conform to a user's wrist when the user is wearing the watch. The insert is formed of a sturdy material, such as resin, such that the watch band is durable and long lasting in the areas of high wear.

DETAILED DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE PREFERRED EMBODIMENTS

Figure 1:
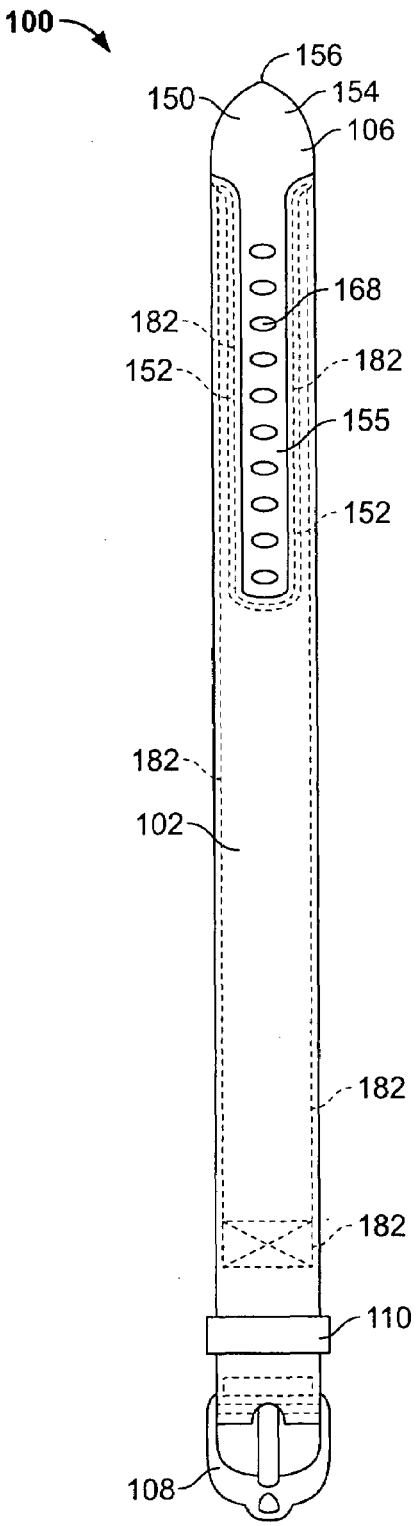
FIG. 1 is a top plan elevational view of a watch band construction of a first embodiment of the invention.

While this invention may be susceptible to embodiments in different forms, there is shown in the drawings and will be described herein in detail, specific embodiments with the understanding that the present disclosure is to be considered an exemplification of the principles of the invention, and is not intended to limit the invention to that as illustrated.

A first embodiment of a watch band construction 100 is shown in FIGS. 1-9 and a second embodiment of the watch band construction 200 is shown in FIGS. 10-19. Like elements are denoted with like reference numerals with the first embodiment being in the one hundreds and the second embodiment being in the two hundreds.

Figure 2:
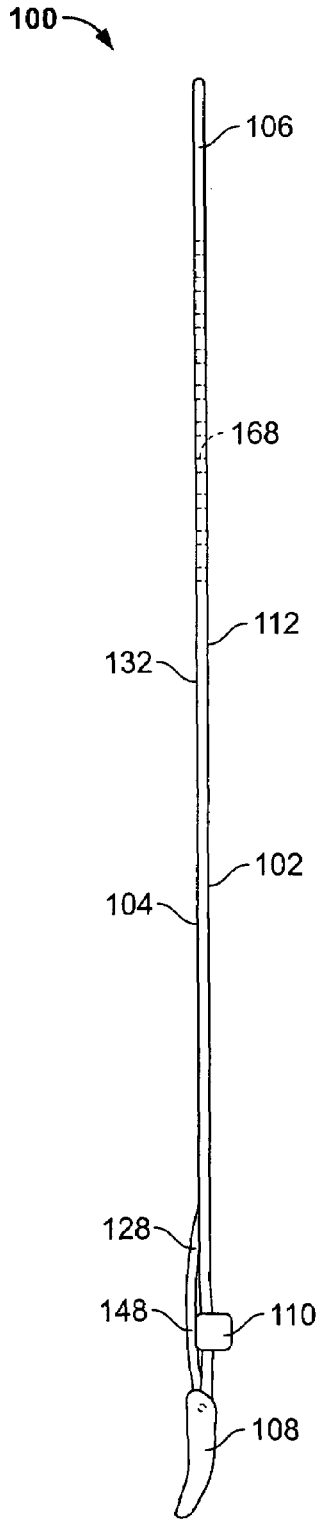
FIG. 2 is a side plan elevational view of the watch band construction of FIG. 1.

Attention is now directed to the watch band construction 100 of the first embodiment of the invention as illustrated in FIGS. 1-9. A final construction of a watch band 100 of the present invention is illustrated in FIGS. 1 and 2. The watch band construction 100 includes a top layer 102, a bottom layer 104, an insert 106, a buckle 108, and a keeper 110.

Figure 3:
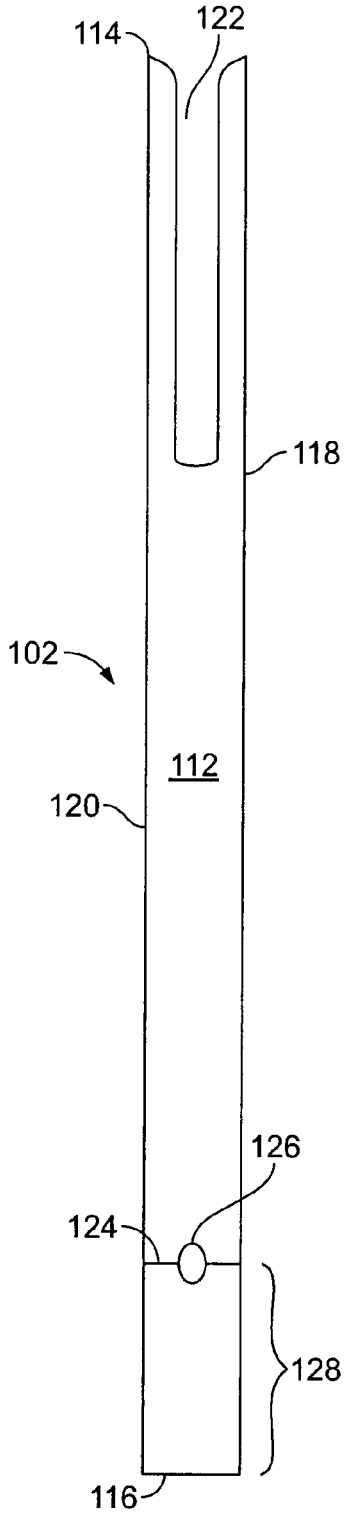
FIG. 3 is a top plan elevational view of a top layer of the watch band construction illustrated in FIG. 1.

The top layer 102 of the watch band 100 is best illustrated in FIG. 3. The top layer 102, in the final construction of the watch band 100, acts as the exterior side of the watch band 100, i.e., the side of the watch band 100 which does not typically contact the user's skin. The top layer 102 is preferably formed of nylon.

The top layer 102 is preferably rectangular in construction such that it has a top surface 112, a bottom surface (not shown), a first or tip end 114, a second end 116 which is opposite the tip end 114, a first side edge 118 which extends from one end of the tip end 114 to one end of the second end 116, and a second side edge 120 which extends from another end of the tip end 114 to another end of the second end 116.

At the tip end 114 of the top layer 102, a die cut aperture 122 is provided. The purpose for providing the die cut aperture 122 at the tip end 114 of the top layer 102 will be discussed in further detail herein.

Proximate to, but distanced from, the second end 116 of the top layer 102, a fold line 124 is provided which extends from the first side edge 118 to the second side edge 120. A hole 126 is cut through the top layer 102 along the fold line 124 equidistant from the first side edge 118 and the second side edge 120. A fold line 124 provides a fold-under overlap portion 128 of the top layer 102 which is provided between the fold line 124 and the second end 116 of the top layer 102. The purpose for providing the fold line 124, the hole 126 and the fold-under overlap portion 128 will be discussed in further detail herein.

Figure 4:
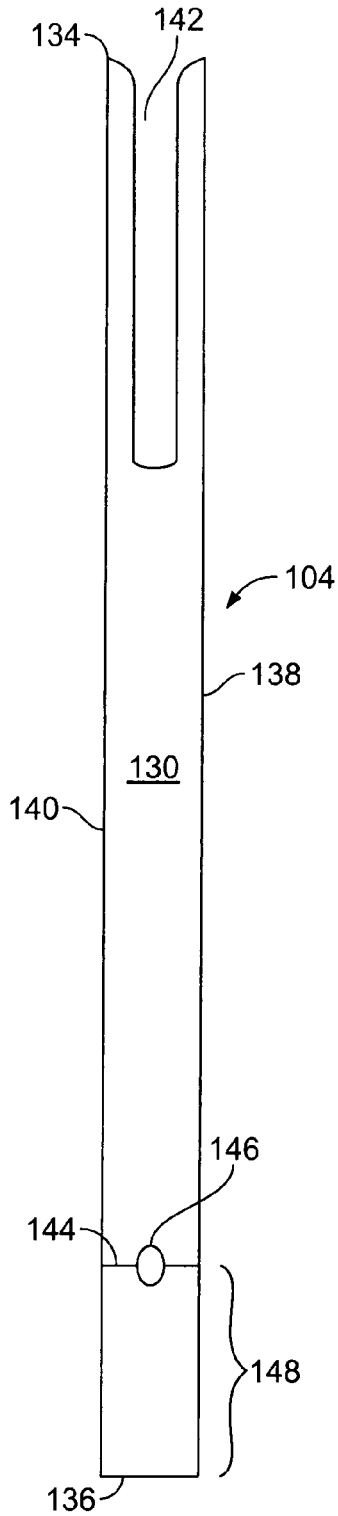
FIG. 4 is a top plan elevational view of a bottom layer of the watch band construction illustrated in FIG. 1.
Figure 5:
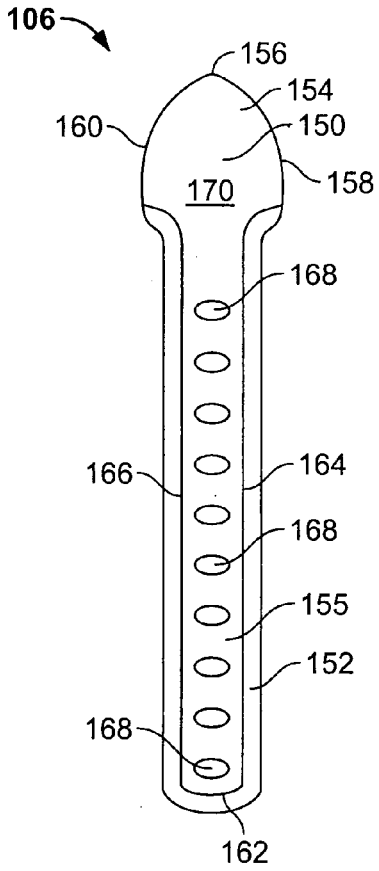
FIG. 5 is a top plan elevational view of an insert of the watch band construction illustrated in FIG. 1.
Figure 6:
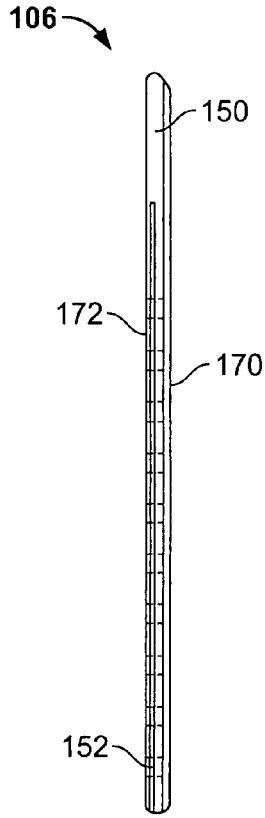
FIG. 6 is a side plan elevational view of the insert of the watch band construction of FIG. 5, which does not illustrate the curve bias of the insert along a length of the insert.

The bottom layer 104 of the watch band 100 is best illustrated in FIG. 4. The bottom layer 104, in the final construction of the watch band 100, acts as the interior side of the watch band 100, i.e., the side of the watch band 100 which contacts the user's skin. The bottom layer 104 is preferably formed of polyester.

The bottom layer 104 is preferably rectangular in construction such that it has a top surface 130, a bottom surface 132, a first or tip end 134, a second end 136 which is opposite the tip end 134, a first side edge 138 which extends from one end of the tip end 134 to one end of the second end 136, and a second side edge 140 which extends from another end of the tip end 134 to another end of the second end 136.

At the tip end 134 of the bottom layer 104, a die cut aperture 142 is provided. The purpose for providing the die cut aperture 142 at the tip end 134 of the bottom layer 104 will be discussed in further detail herein.

Proximate to, but distanced from, the second end 136 of the bottom layer 104, a fold line 144 is provided which extends from the first side edge 138 to the second side edge 140. A hole 146 is cut through the bottom layer 104 along the fold line 144 equidistant from the first side edge 138 and the second side edge 140. A fold line 144 provides a fold-under overlap portion 148 of the bottom layer 104 which is provided between the fold line 144 and the second end 136 of the bottom layer 104. The purpose for providing the fold line 144, the hole 146 and the fold-under overlap portion 148 will be discussed in further detail herein.

It should be noted that upon placing the top layer 102 on top of the bottom layer 104, such that the bottom surface of the top layer 102 is in contact with the top surface 130 of the bottom layer 104, the top and bottom layers 102, 104 are preferably identical in every manner except that the top layer 102 is preferably thicker than the bottom layer 104, and the top and bottom layers 102, 104 are formed of different materials. Thus, the die cut apertures 122, 142 are identically positioned in the top and bottom layers 102, 104, respectively, relative to one another. Likewise, the fold lines 124, 144, the holes 126, 146, and the fold-over overlay portions 128, 148 are identically positioned in the top and bottom layers 102, 104, respectively, relative to one another.

The insert 106 of the watch band 100 is illustrated in FIGS. 5-7 and 9. The insert 106 has a first portion 150 and a second portion 152. The insert 106 is preferably formed of a resin material, such as polyurethane or santoprene, which is stronger and more durable than the materials of the top and bottom layers 102, 104.

The first portion 150 has a tip portion 154 and a band hole portion 155. The tip portion 154 has a first end or tip 156 which is formed by the junction of a first side edge 158 of the tip portion 154 to a second side edge 160 of the tip portion 154. From the tip 156, the first and second side edges 158, 160 preferably extend outwardly in a concave manner until the first and second side edges 158, 160 are at their largest predetermined distance apart, which is preferably the same as the width of the top and bottom layers 102, 104. The band hole portion 155 extends from the tip portion 154, where the first and second side edges 158, 160 are at their largest predetermined distance apart, to a second end 162 of the first portion 150. The band hole portion 155 has a first side edge 164, which extends from the first side edge 158 of the tip portion 154 to the second end 162 of the first portion 150. The band hole portion 155 further has a second side edge 166, which extends from the second side edge 160 of the tip portion 154 to the second end 162 of the first portion 150. The band hole portion 155 is sized to fit within the die cut apertures 122, 142 of the top and bottom layers 102, 104. The band hole portion 155 has a plurality of holes 168 provided therethrough which are distanced from one another a predetermined distance. The first portion 150 preferably has an arced or curved bias between the first and second side edges 158, 164; 160, 166.

The second portion 152 acts as a stitching shelf and is connected to, and extends along, the first and second side edges 164, 166 and the second end 162 of the band hole portion 155 of the first portion 150. The second portion 152 preferably is positioned between a top surface 170 and a bottom surface 172 of the first portion 150 along the edges 164, 166 and the end 162 thereof and extends outwardly therefrom.

Figure 9:
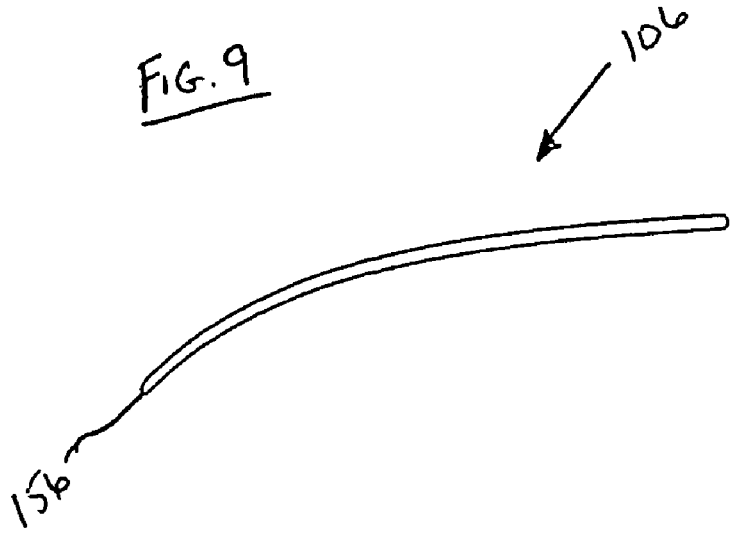
FIG. 9 is a side plan elevational view of the insert of the watch band construction which illustrates the curve bias of the insert along a length of the insert.

The insert 106 also preferably has an arced or curved bias from the tip 156 of the tip portion 154 to the opposite end of the insert 106 as best illustrated in FIG. 9. This curved or arced bias is illustrated only in FIG. 9 and not in the other illustrations of the insert 106 solely or of the watch band construction 100 for ease in illustration purposes.

Figure 8:
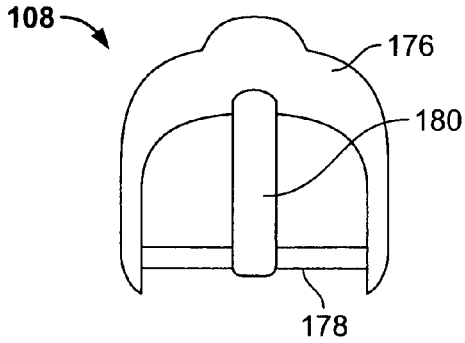
FIG. 8 is a top plan elevational view of a buckle of the watch band construction illustrated in FIG. 1.

The buckle 108 of the watch band 100 is of a type well-known in the art and, therefore, will not be described in detail herein other than to denote a U-shaped portion 176, a pin 178, and a prong 180, as illustrated in FIG. 8. The keeper 110 of the watch band 100 is also of a type well-known in the art and, therefore, will not be described in detail.

Construction of the watch band 100 will now be discussed. The insert 106 is positioned or sandwiched between the top and bottom layers 102, 104 such that the band hole portion 155 of the insert 106 is positioned within the die cut apertures 122, 142 of the top and bottom layers 102, 104. When the insert 106 is positioned within the die cut apertures 122, 142, the second portion or stitching shelf 152 of the insert 106 is provided between the bottom surface of the top layer 102 and the top surface 130 of the bottom layer 104. The tip portion 154 of the insert 106 is positioned beyond the first ends 114, 134 of the top and bottom layers 102, 104. The stitching shelf 152 of the insert 106 is then stitched to both the top and bottom layers 102, 104, using a high tenacity thread 182, such that the insert 106 is secured to the top and bottom layers 102, 104. All sides of the insert 106 are flush with or even with all surfaces of the top and bottom layers 102, 104.

The top and bottom layers 102, 104 are then stitched to one another along the first side edges 118, 138 and the second side edges 120, 140 thereof from the first ends 114, 134 to the second ends 116, 136, using the high tenacity thread 182.

The second ends 116, 136 of the top and bottom layers 102, 104 are then inserted through the keeper 110, which is hollow, and the keeper 110 is positioned proximate to the fold lines 124, 144, but distal to the second ends 116, 136. The keeper 110 is then secured to the top and/or bottom layer 102, 104 by appropriate means, which are well-known in the art.

The buckle 108 is then secured to the top and bottom layers 102, 104 of the watch band 100 by inserting the prong 180 through the hole 146 of the bottom layer 104, and then through the hole 126 of the top layer 102. The pin 178 of the buckle 108 is provided along the bottom surface 132 of the bottom layer 104 proximate to the fold line 144 such that the U-shaped portion 176 of the buckle 108 extends around the first and second side edges 118, 120; 138, 140 of the top and bottom layers 102, 104 such that the prong 180 can be positioned against the U-shaped portion 176.

The fold-under overlay portions 128, 148 of the top and bottom layers 102, 104 are then folded along the fold lines 122, 124 of the top and bottom layers 102, 104 such that the bottom surface 132 of the bottom layer 104 at the second end 136 thereof is positioned against the bottom surface 132 of the bottom layer 104 proximate to where the keeper 110 is secured to the bottom layer 104, with the keeper 110 being closer to the fold line 144. The second ends 116, 136 of the top and bottom layers 102, 104 are then secured in place to the top and bottom layers 102, 104 proximate to the keeper 110, preferably by stitching a box stitch with the high tenacity thread 182.

Figure 7:
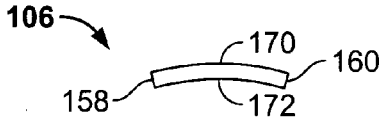
FIG. 7 is a front plan elevational view of the insert of the watch band construction of FIG. 5 illustrating the curve bias of the insert along a width of the insert.

Thus, the watch band 100 is provided. The watch band 100 provides improved durability without sacrificing comfort and styling. The resin insert 106 of the watch band 100 forms the holes 168 and the tip end 156, effectively eliminating all raw edges, and maximizing the durability of the band 100 in the high wear areas of the pointed tip 156 and holes 168. The resin or plastic like materials of the insert 106 are durable and long lasting, hold up well, and eliminate all fraying. The resin or plastic like materials of the insert 106 facilitate ease of use as the prong 180 of the buckle 108 easily inserts through one of the holes 168 of the insert 106. There is no issue of the prong 180 getting hung up on loose threads during insertion. As the insert 106 is curved slightly both along a length of the insert 106, as illustrated in FIG. 9, and along a width of the insert 106, as illustrated in FIG. 7, an ergonomic radius follows the curve of the wrist when wearing. This bias in the molded resin inset facilitates ease of putting on the watch band 100 as well as comfort while wearing. The ergonomic curve also improves ease of use. The insert 106 creates a smooth, comfortable, non-obtrusive surface.

Figure 10:
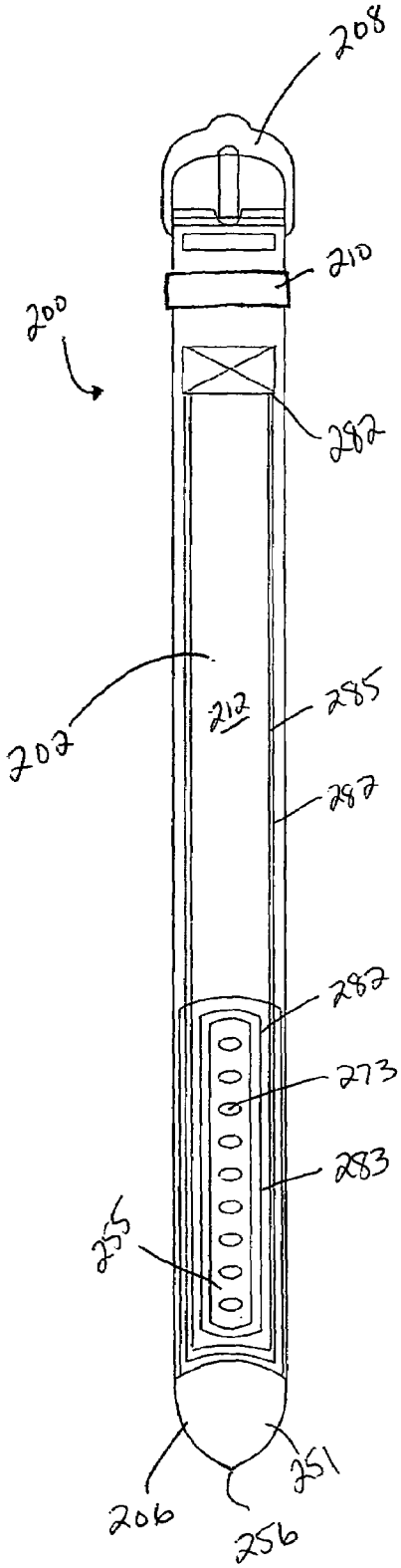
FIG. 10 is a top plan elevational view of a watch band construction of a second embodiment of the invention.
Figure 11:
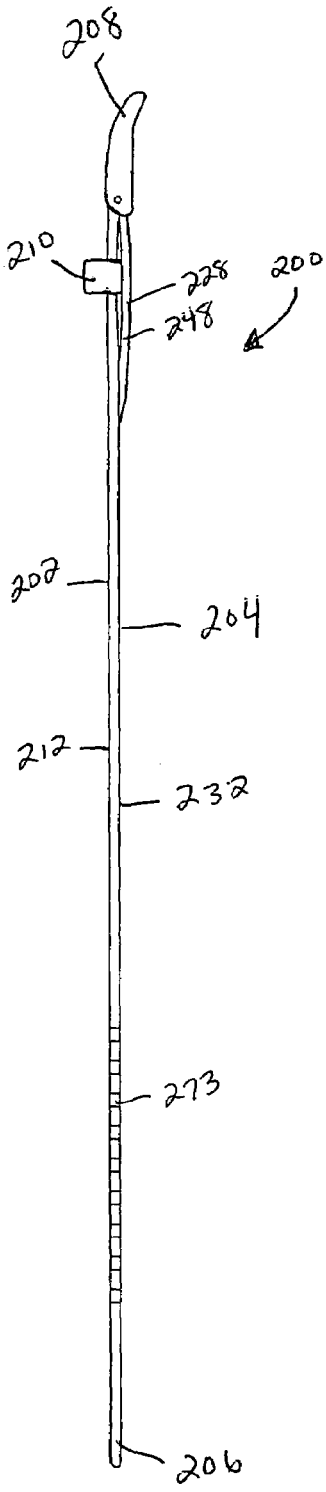
FIG. 11 is a side plan elevational view of the watch band construction of FIG. 10.

Attention is now directed to the watch band construction 200 of the second embodiment of the invention as illustrated in FIGS. 10-19. A final construction of a watch band 200 of the present invention is illustrated in FIGS. 10 and 11. The watch band construction 200 includes a top layer 202, a bottom layer 204, an insert 206, a buckle 208, and a keeper 210.

Figures 12, 13, 14, 15, 16, 17, 18, 19:
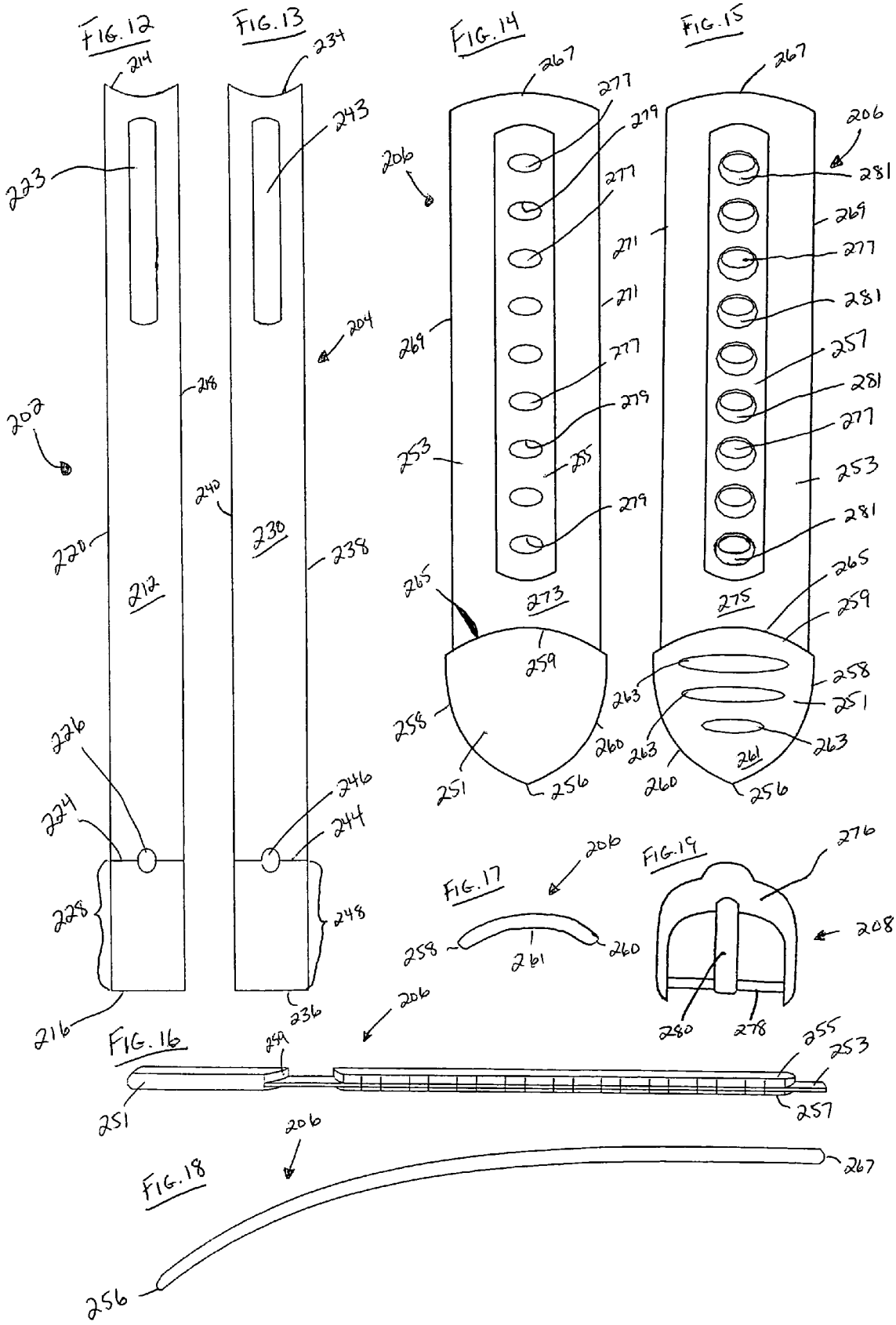
FIG. 12 is a top plan elevational view of a top layer of the watch band construction illustrated in FIG. 10.
FIG. 13 is a top plan elevational view of a bottom layer of the watch band construction illustrated in FIG. 10.
FIG. 14 is a top plan elevational view of an insert of the watch band construction illustrated in FIG. 10.
FIG. 15 is a bottom plan elevational view of the insert illustrated in FIG. 14.
FIG. 16 is a side plan elevational view of the insert of the watch band construction of FIGS. 14 and 15, which does not illustrate the curve bias of the insert along a length of the insert.
FIG. 17 is a front plan elevational view of the insert of the watch band construction of FIG. 14 illustrating the curve bias of the insert along a width of the insert.
FIG. 18 is a side plan elevational view of the insert of the watch band construction which illustrates the curve bias of the insert along a length of the insert.
FIG. 19 is a top plan elevational view of a buckle of the watch band construction illustrated in FIG. 10.
Figure 1:
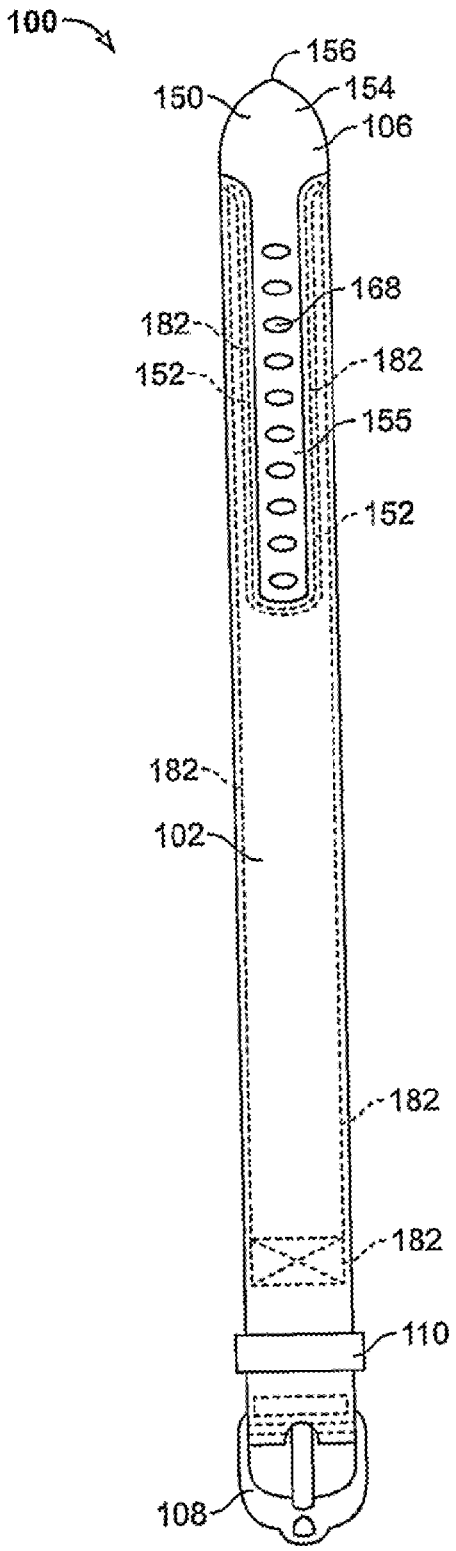
Figure 2:
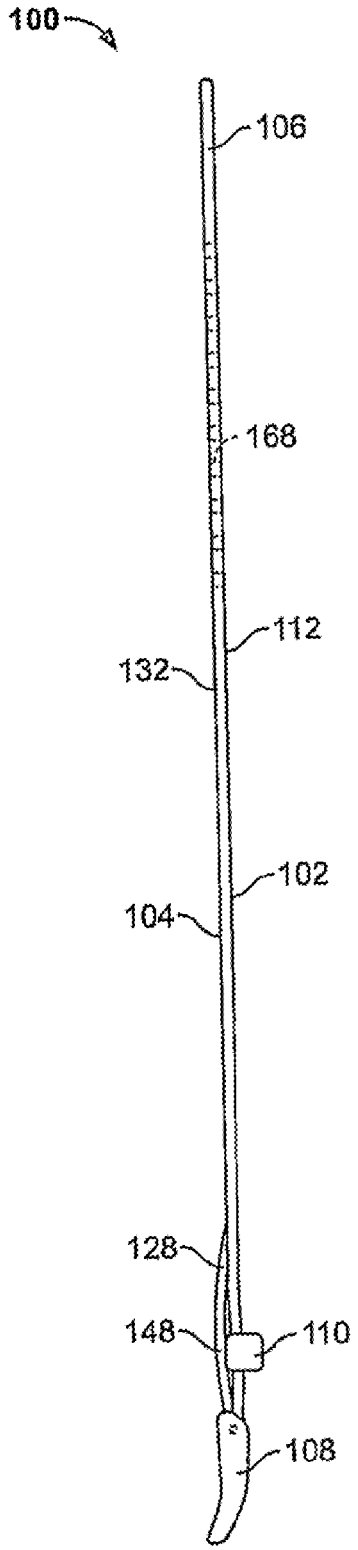
Figure 3:
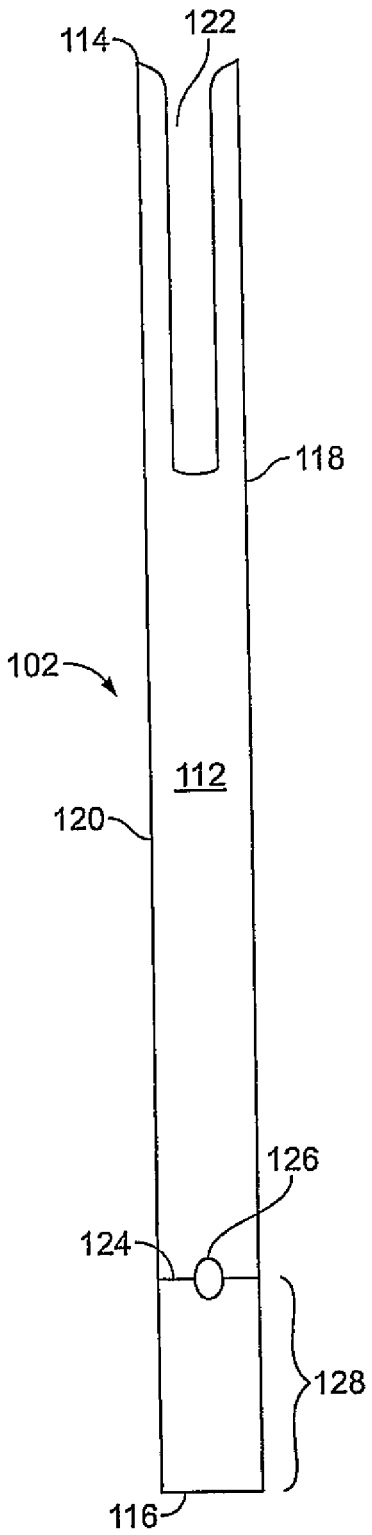
Figure 4:
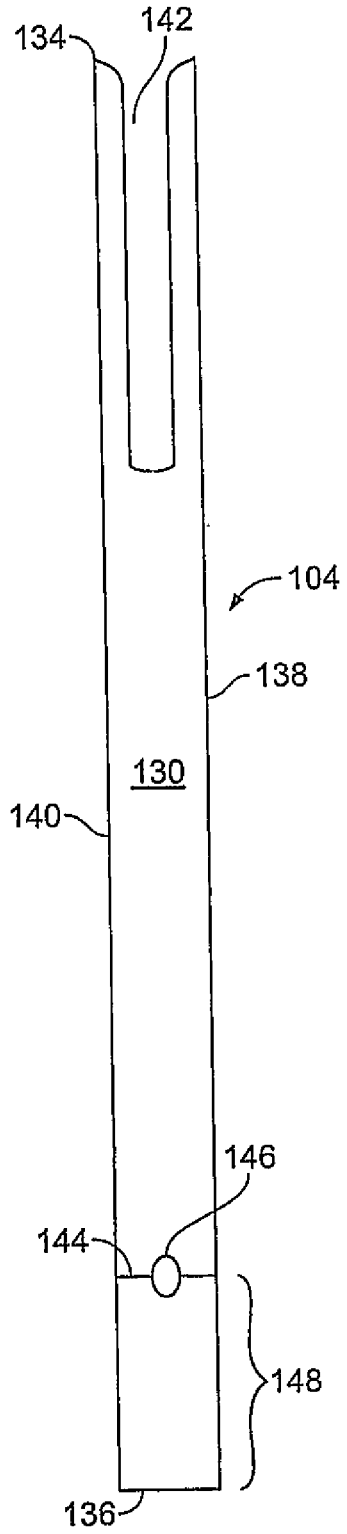
Figure 5:
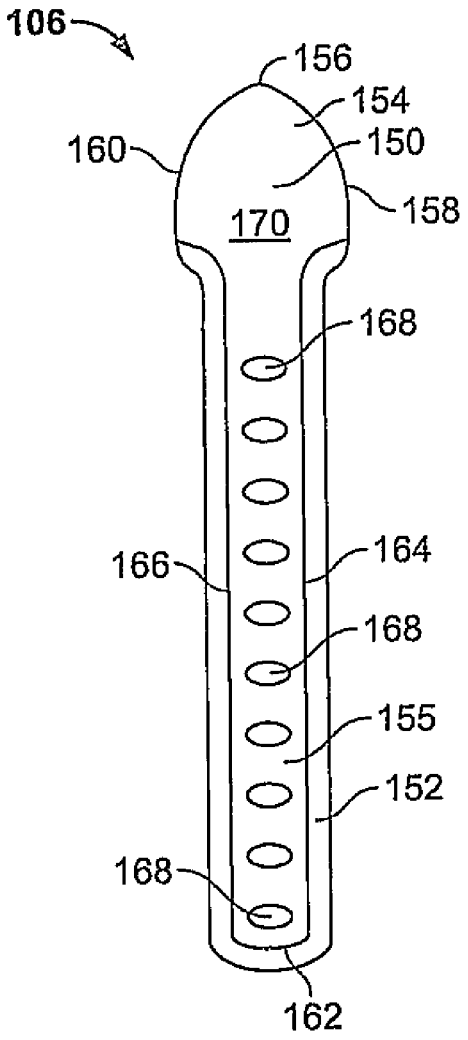
Figure 6:
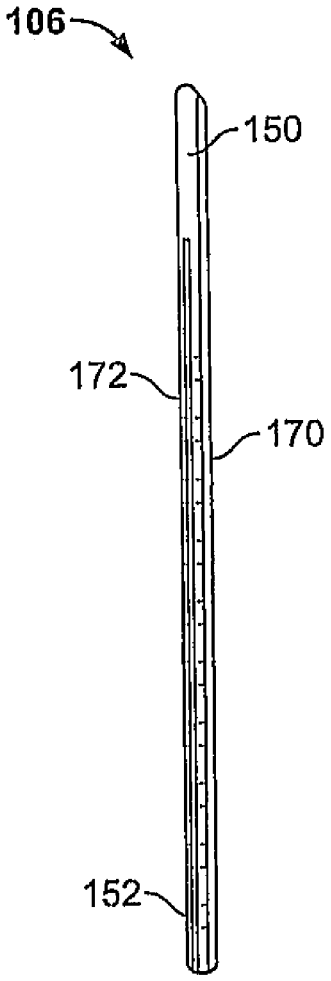
Figure 7:
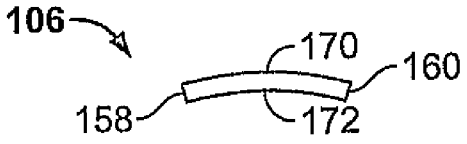
Figure 8:
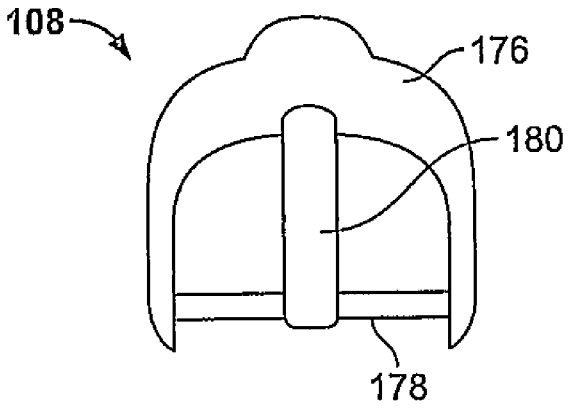
Figure 9:
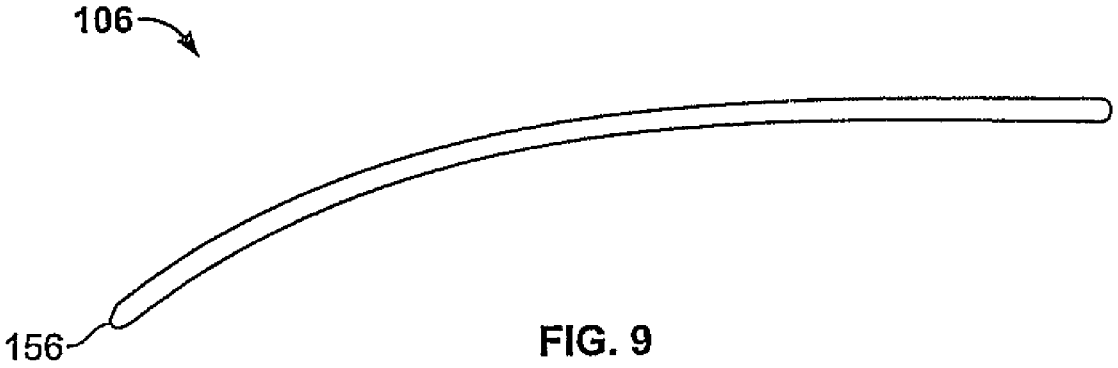
Figure 10:
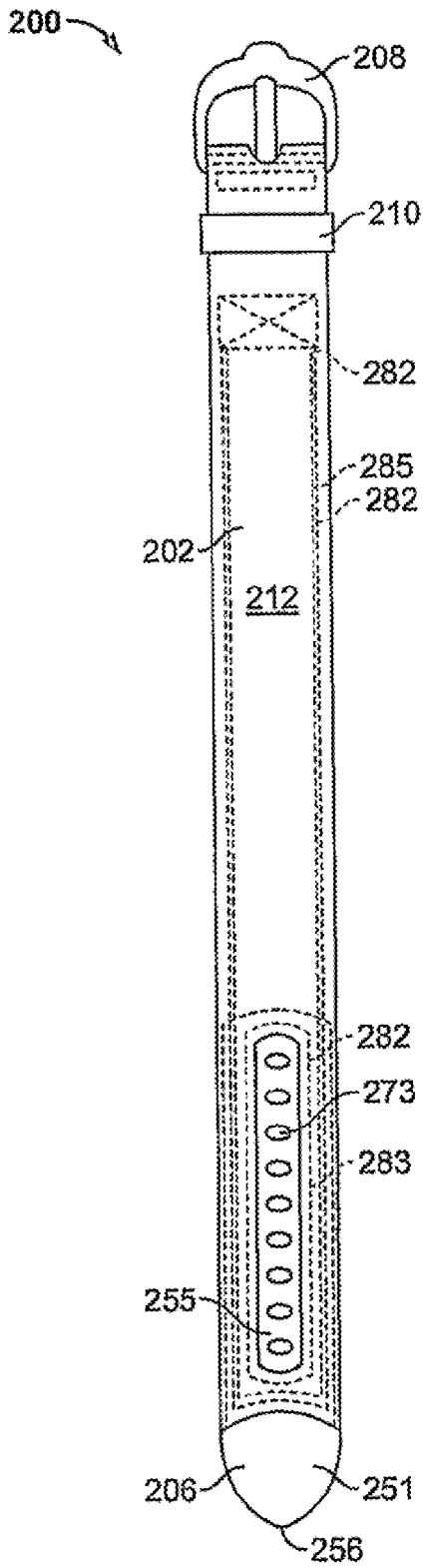
Figure 11:
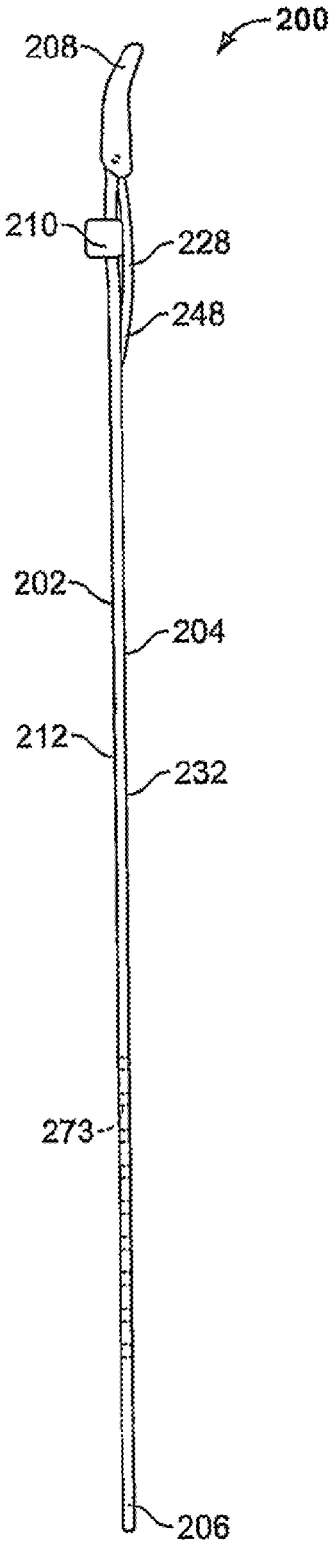
Figure 12:
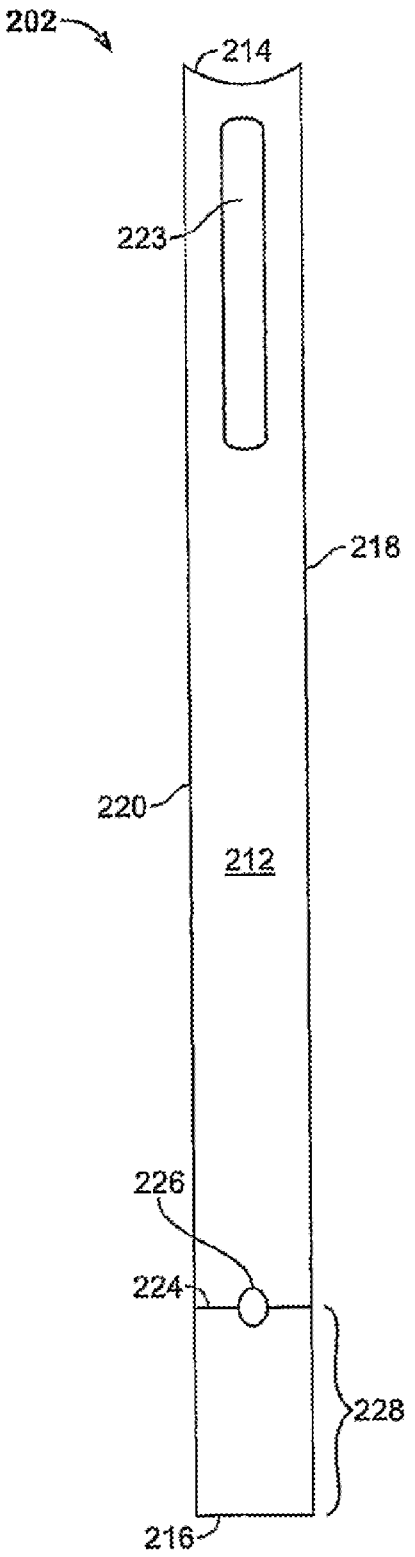
Figure 13:
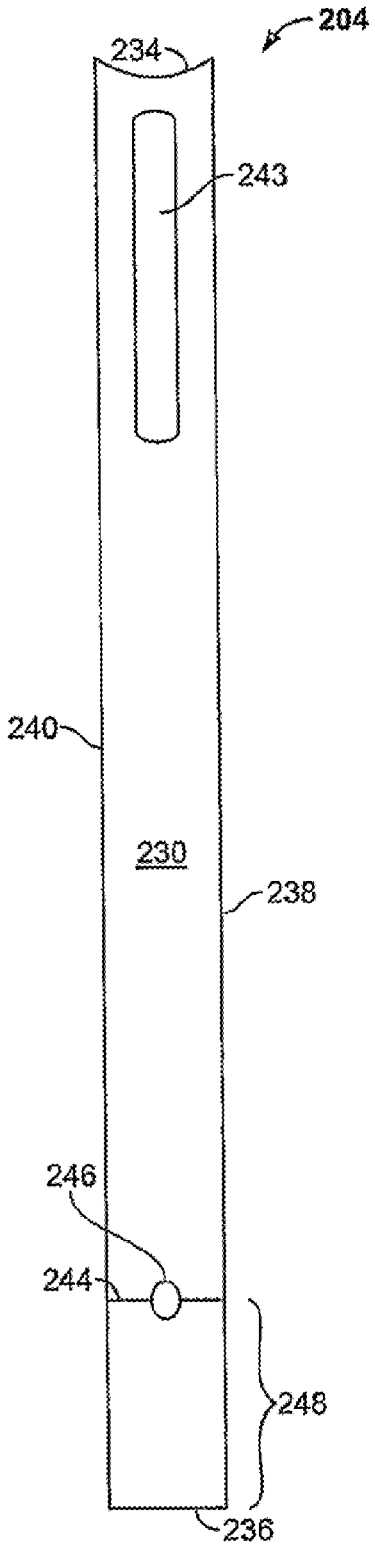
Figure 14:
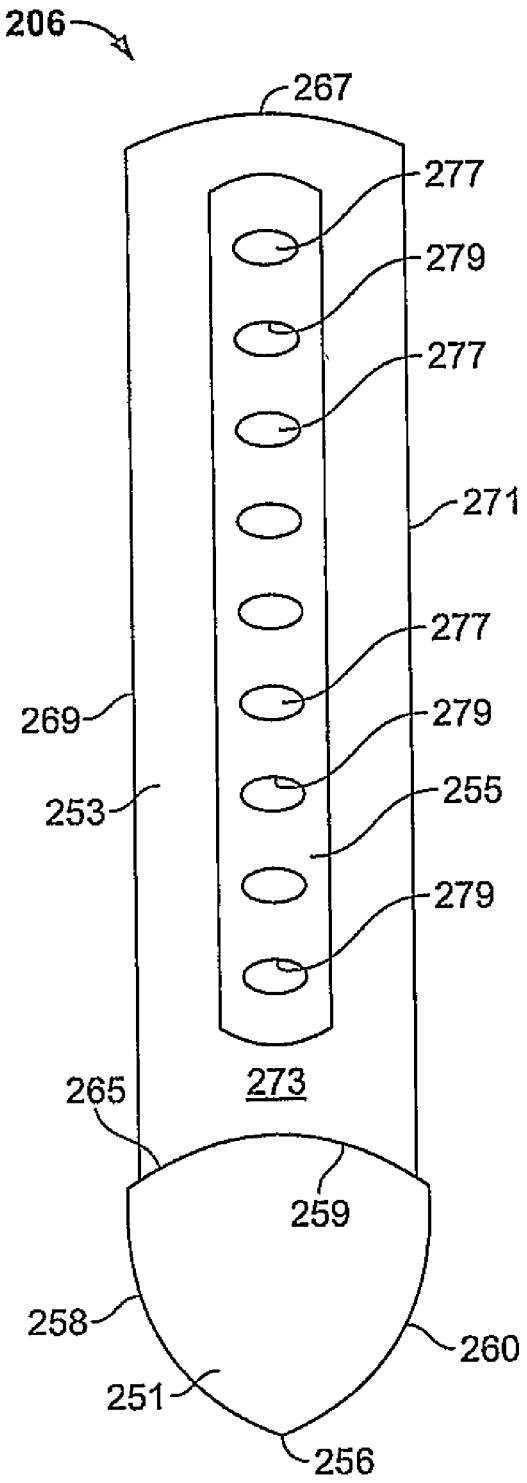
Figure 15:
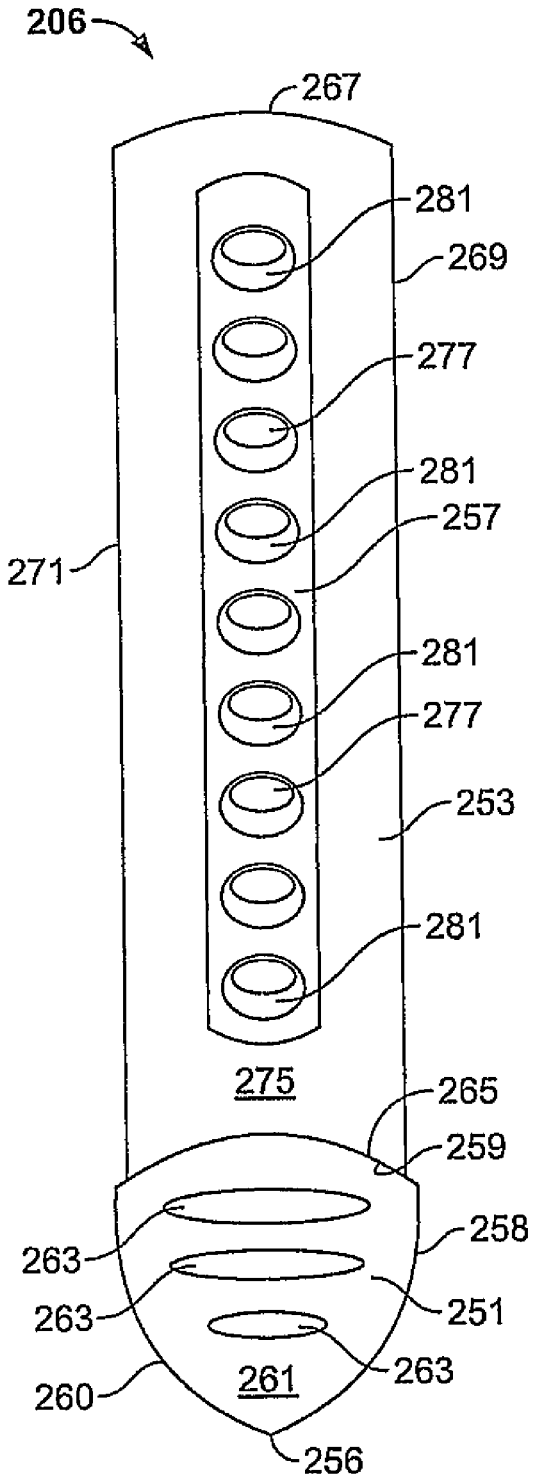
Figure 16:
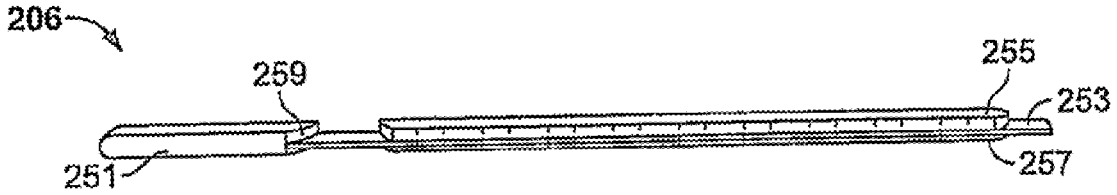
Figure 17:
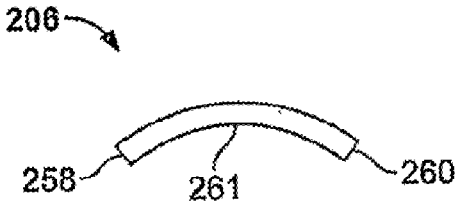
Figure 18:
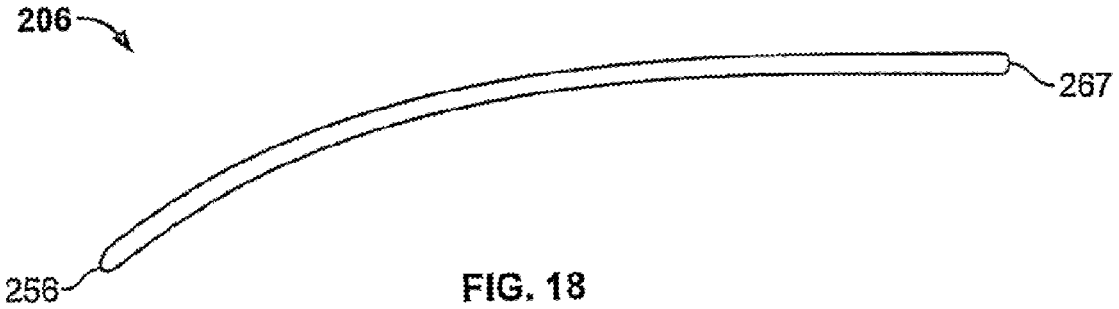
Figure 19:
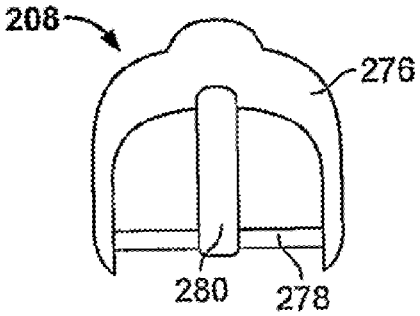
Figure 1:
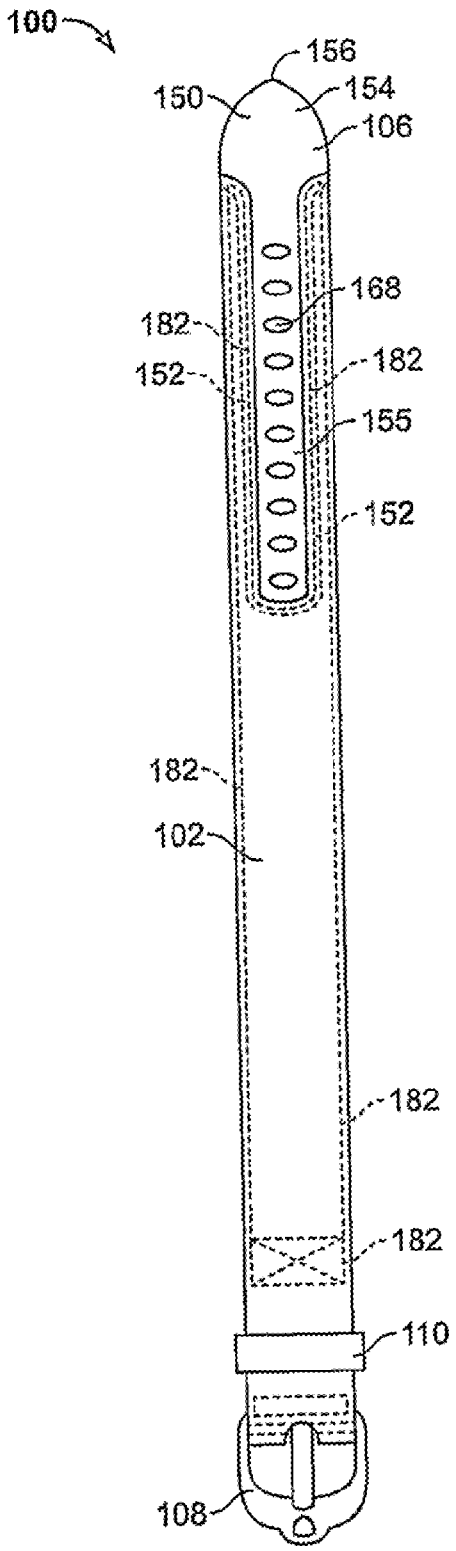
Figure 2:
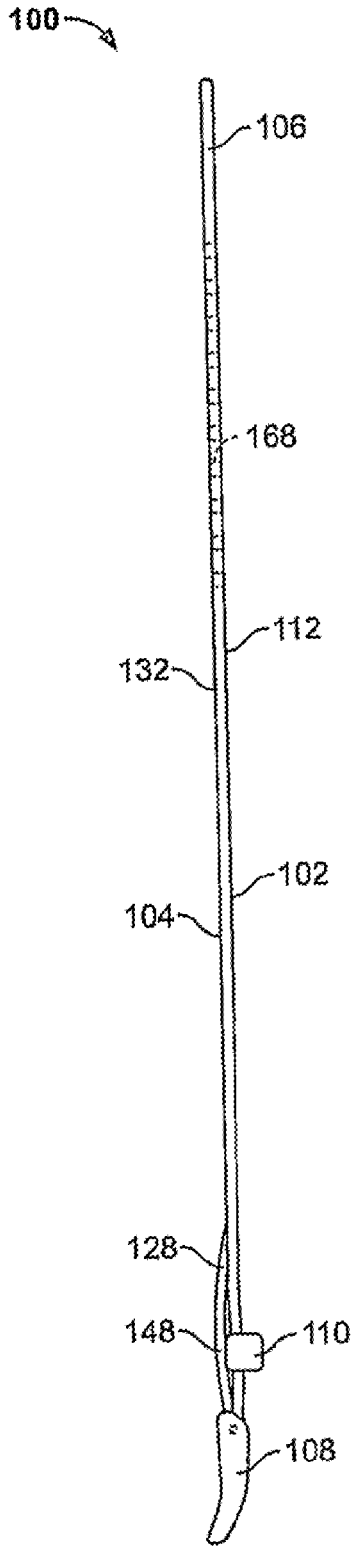
Figure 3:
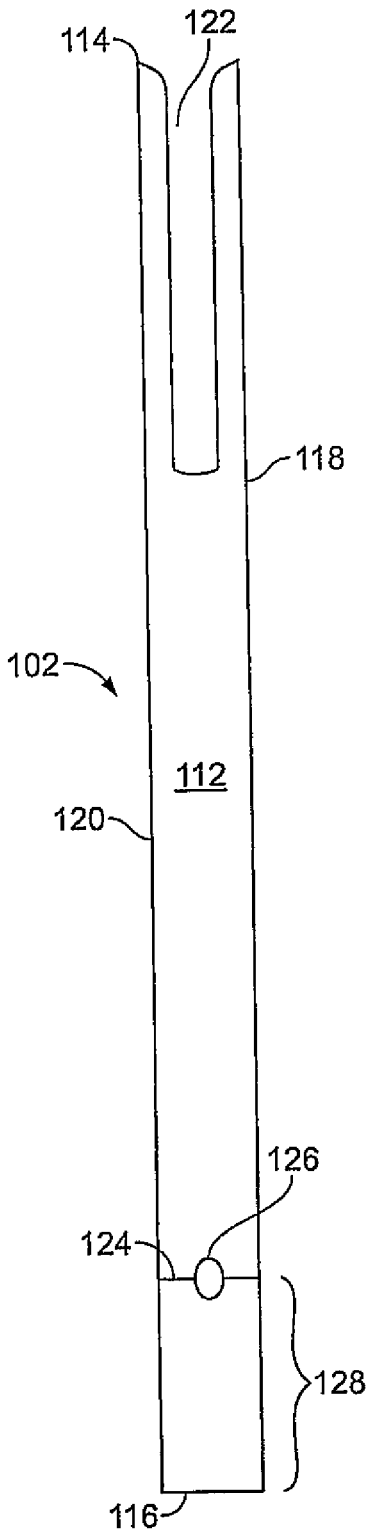
Figure 4:
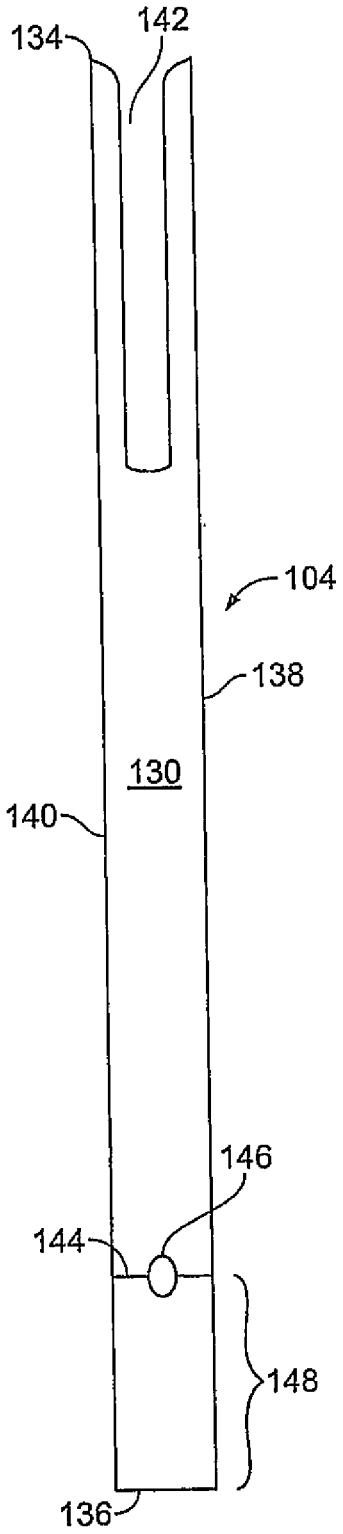
Figure 5:
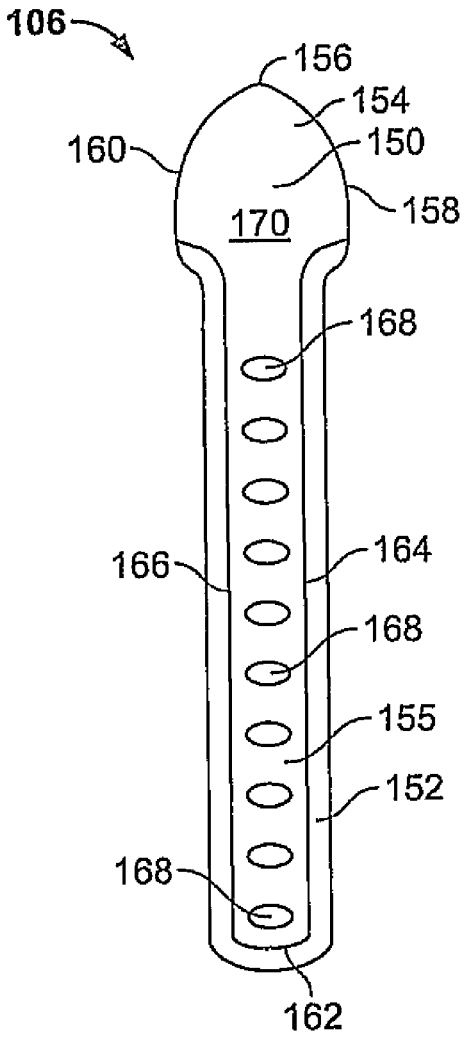
Figure 6:
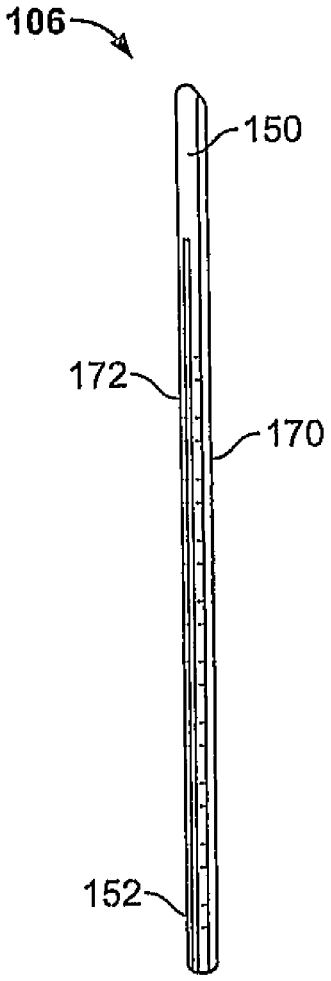
Figure 7:
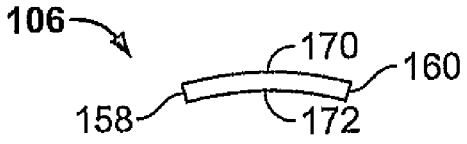
Figure 8:
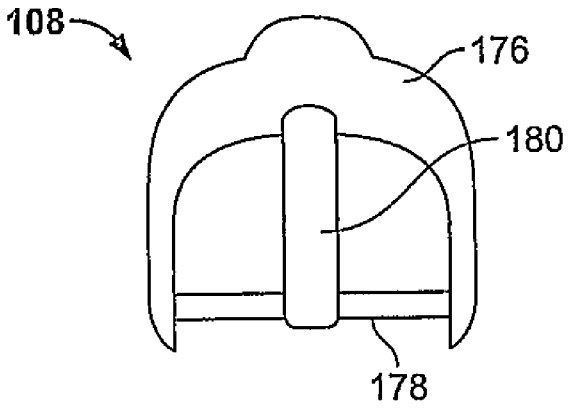
Figure 9:
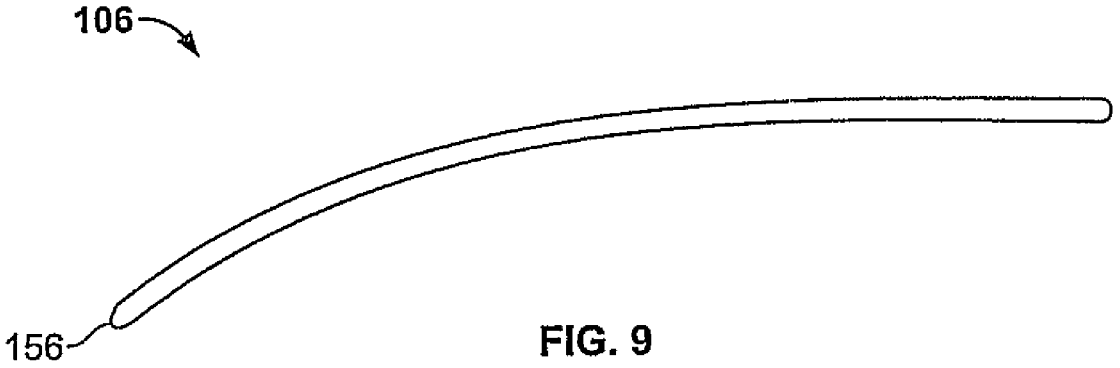
Figure 10:
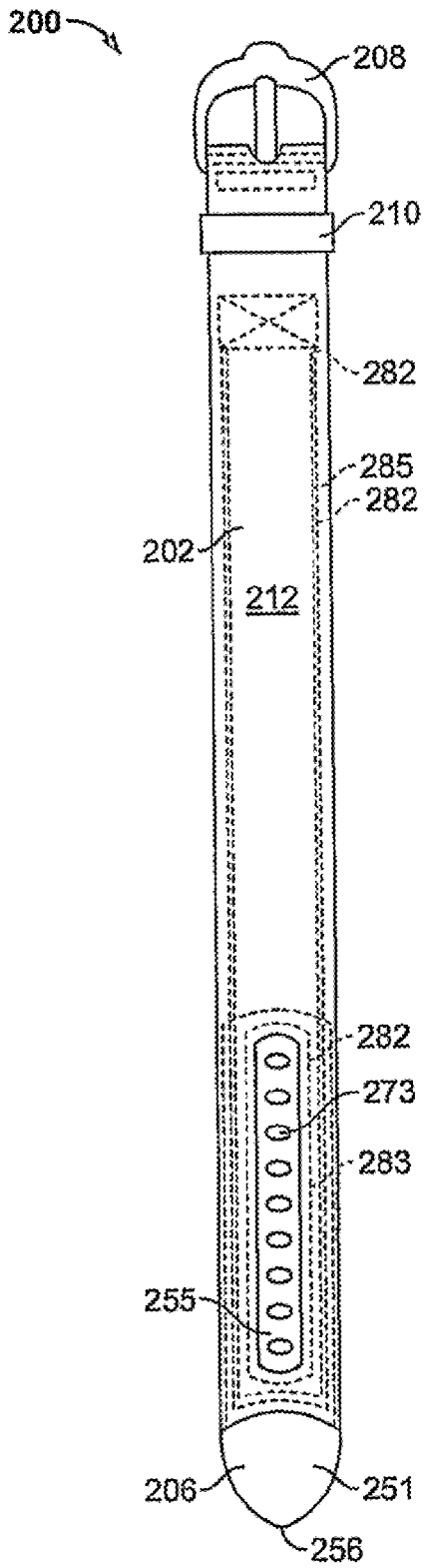
Figure 11:
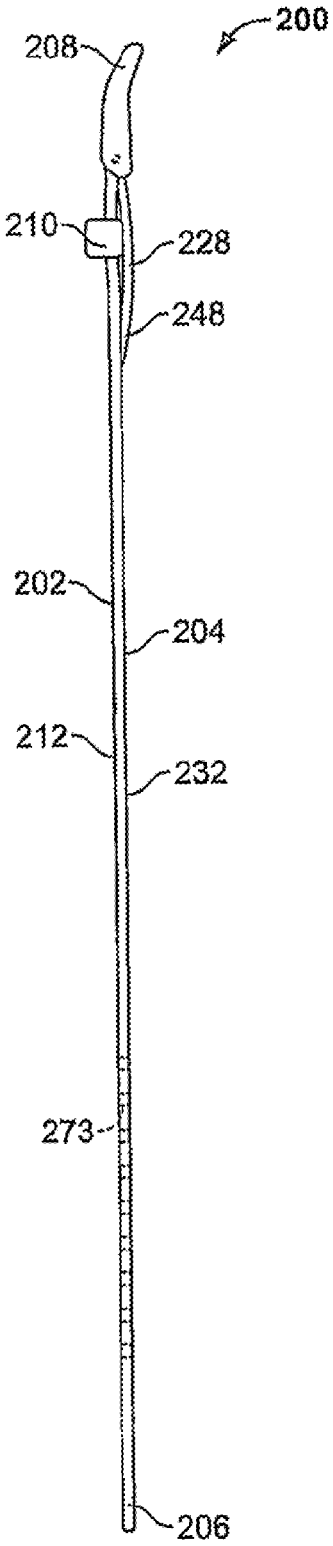
Figure 12:
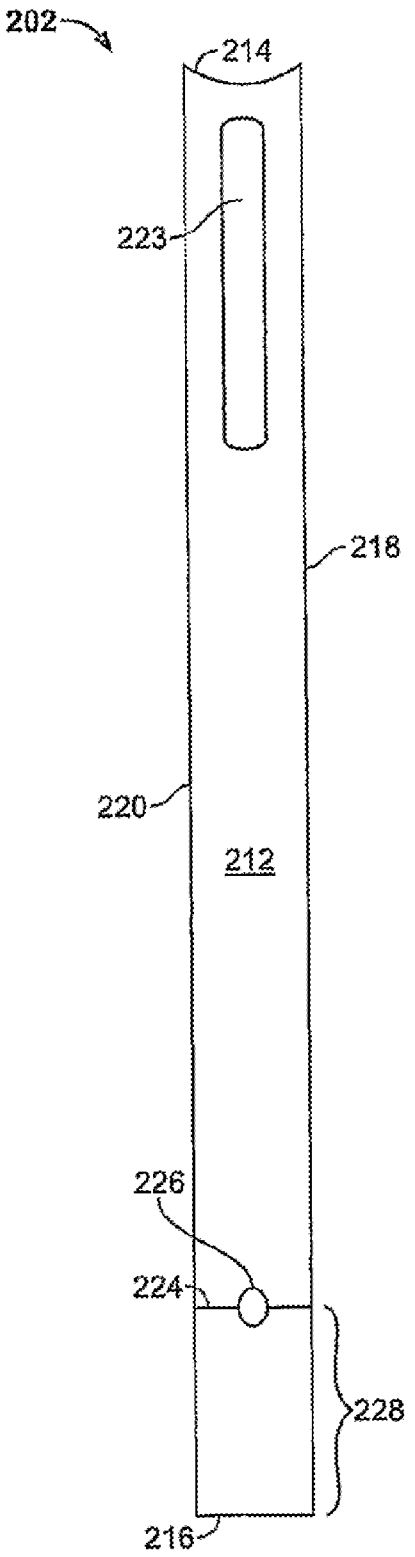
Figure 13:
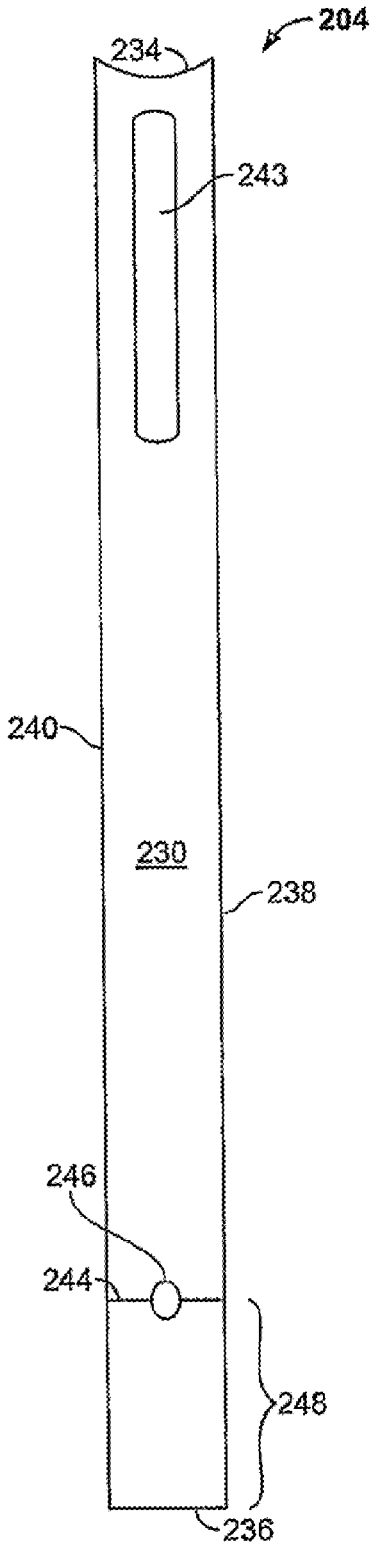
Figure 14:
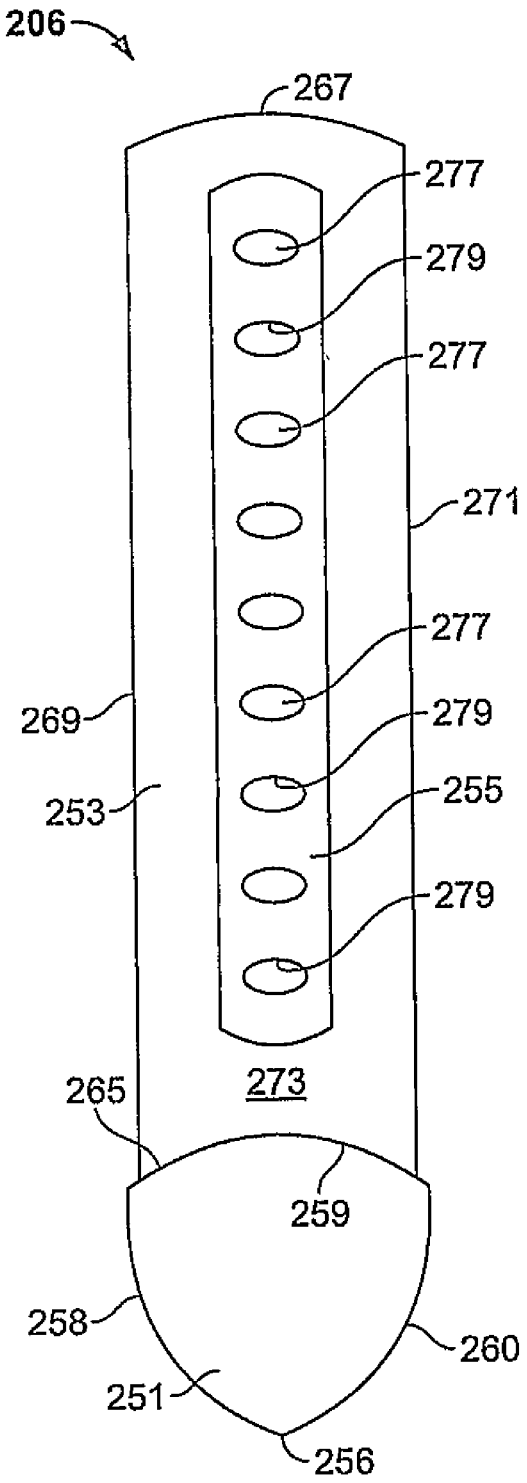
Figure 15:
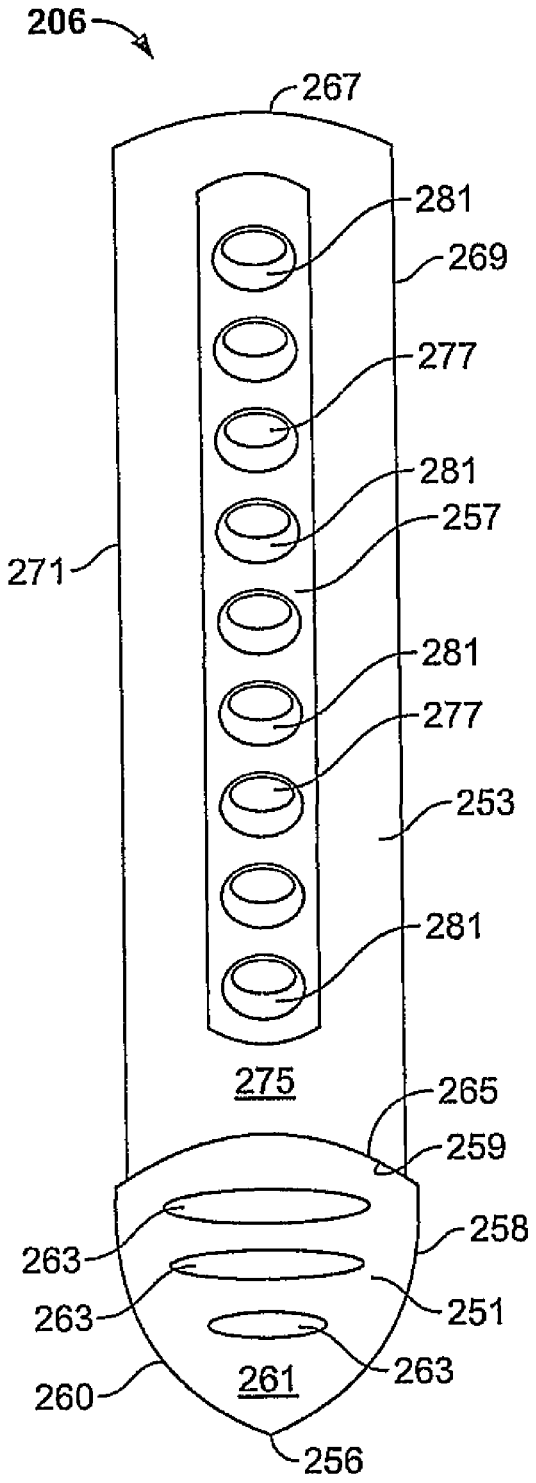
Figure 16:
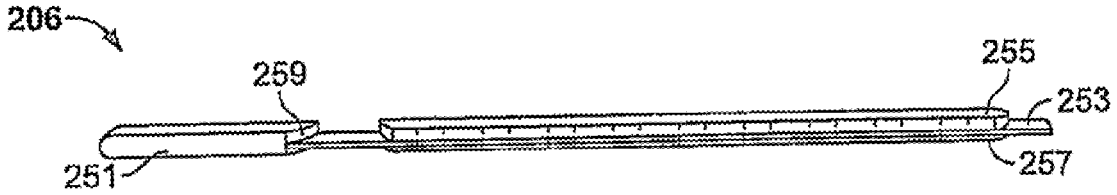
Figure 17:
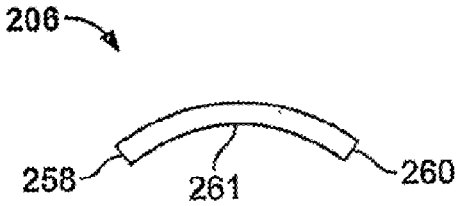
Figure 18:
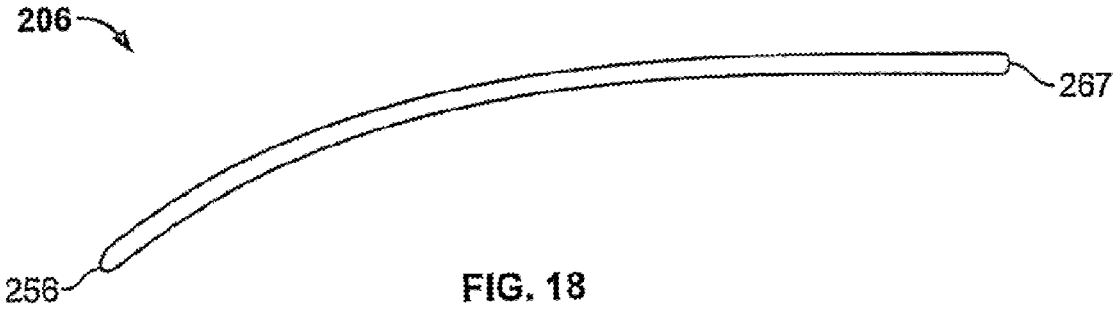
Figure 19:
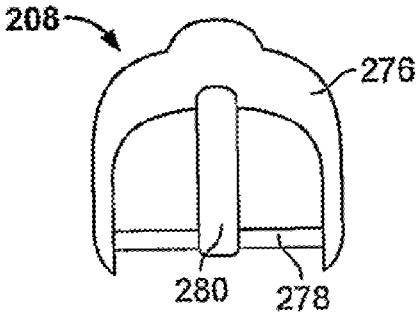

The top layer 202 of the watch band 200 is best illustrated in FIG. 12. The top layer 202, in the final construction of the watch band 200, acts as the exterior side of the watch band 200, i.e., the side of the watch band 200 which does not typically contact the user's skin. The top layer 202 is preferably formed of nylon.

The top layer 202 is preferably rectangular in construction such that it has a top surface 212, a bottom surface (not shown), a first or tip end 214, a second end 216 which is opposite the tip end 214, a first side edge 218 which extends from one end of the tip end 214 to one end of the second end 216, and a second side edge 220 which extends from another end of the tip end 214 to another end of the second end 216.

The tip end 214 of the top layer 202 is preferably concave for reasons which will be discussed further herein. Proximate to the tip end 214 of the top layer 202, a die cut aperture 223 is provided. The purpose for providing the die cut aperture 223 proximate to the tip end 214 of the top layer 202 will be discussed in further detail herein.

Proximate to, but distanced from the second end 216 of the top layer 202, a fold line 224 is provided which extends from the first side edge 218 to the second side edge 220. A hole 226 is cut through the top layer 202 along the fold line 224 equidistant from the first side edge 218 and the second side edge 220. A fold line 224 provides a fold-under overlap portion 228 of the top layer 202 which is provided between the fold line 224 and the second end 216 of the top layer 202. The purpose for providing the fold line 224, the hole 226 and the fold-under overlap portion 228 will be discussed in further detail herein.

The bottom layer 204 of the watch band is best illustrated in FIG. 13. The bottom layer 204, in the final construction of the watch band 200, acts as the interior side of the watch band 200, i.e., the side of the watch band 200 which contacts the user's skin. The bottom layer 204 is preferably formed of polyester.

The bottom layer 204 is preferably rectangular in construction such that it has a top surface 230, a bottom surface 232, a first or tip end 234, a second end 236 which is opposite the tip end 234, a first side edge 238 which extends from one end of the tip end 234 to one end of the second end 236, and a second side edge 240 which extends from another end of the tip end 234 to another end of the second end 236.

The tip end 234 of the bottom layer 204 is preferably concave for reasons which will be discussed further herein.

Proximate to the tip end 234 of the bottom layer 204, a die cut aperture 243 is provided. The purpose for providing the die cut aperture 243 proximate to the tip end 234 of the bottom layer 204 will be discussed in further detail herein.

Proximate to, but distanced from, the second end 236 of the bottom layer 204, a fold line 244 is provided which extends from the first side edge 238 to the second side edge 240. A hole 246 is cut through the bottom layer 204 along the fold line 244 equidistant from the first side edge 238 and the second side edge 240. A fold line 244 provides a fold-under overlap portion 248 of the bottom layer 204 which is provided between the fold line 244 and the second end 236 of the bottom layer 204. The purpose for providing the fold line 244, the hole 246 and the fold-under overlap portion 248 will be discussed in further detail herein.

It should be noted that upon placing the top layer 202 on top of the bottom layer 204, such that the bottom surface of the top layer 202 is in contact with the top surface 230 of the bottom layer 204, the top and bottom layers 202, 204 are preferably identical in every manner except that the top layer 202 is preferably thicker than the bottom layer 204, and the top and bottom layers 202, 204 are formed of different materials. Thus, the die cut apertures 223, 243 are identically positioned in the top and bottom layers 202, 204, respectively, relative to one another. Likewise, the fold lines 224, 244, the holes 226, 246, and the fold-over overlay portions 228, 248 are identically positioned in the top and bottom layers 202, 204, respectively, relative to one another.

The insert 206 of the watch band 200 is illustrated in FIGS. 14-16. The insert 206 has a first portion 251, a second portion 253, a third portion 255, and a fourth portion 257. The insert 206 is preferably formed of a resin material, such as polyurethane or santoprene, which is stronger and more durable than the materials of the top and bottom layers 202, 204.

The first portion 251 acts as a tip portion of the insert 206. The first portion 251 has a first end or tip 256 which is formed by the junction of a first side edge 258 of the first portion 251 to a second side edge 260 of the first portion 251. From the tip 256, the first and second side edges 258, 260 preferably extend outwardly in a concave manner until the first and second side edges 258, 260 are at their largest predetermined distance apart, which is preferably the same as the width of the top and bottom layers 202, 204. A third side edge 259 of the first portion 251 connects the first and second side edges 258, 260 together where the first and second side edges 258, 260 are at their largest predetermined distance apart. The third side edge 259 is convex such that it mates with the concave tip ends 214, 234 of the top and bottom layers 202, 204, respectively. A bottom side 261 of the first portion 251 has a plurality of raised portions 263 extending therefrom. The raised portions 263 are preferably in the form of oval bumps, number three, and increase in size from the tip 256 to the third side edge 259.

The second portion 253 acts as a stitching shelf of the insert 206. The second portion 253 has a first end edge 265, a second end edge 267, and first and second side edges 269, 271 which connect the first end edge 265 to the second end edge 267. The first end edge 265 is concave such that it mates with the convex third side edge 259 of the first portion 251. The first end edge 265 is fixedly connected to, and is preferably integrally formed with, the third side edge 259 of the first portion 251 of the insert 206. The second end edge 267 is preferably convex. The second portion 253 has a top surface 273 and a bottom surface 275 and a thickness which is less than a thickness of the first portion 251.

The third portion 255 is positioned on the top surface 273 of the second portion 253 such that the third portion 255 fits within the die cut aperture 223 of the top layer 202. The third portion 255 is distanced from the first portion 251.

The fourth portion 257 is positioned on the bottom surface 275 of the second portion 253 such that the fourth portion 257 fits within the die cut aperture 243 of the bottom layer 204. The fourth portion 257 is distanced from the first portion 251.

The insert 206 has a thickness where the second, third and fourth portions 253, 255, 257 are provided which is generally equivalent to the thickness of the first portion 251 of the insert 206.

The insert 206 preferably has an arced or curved bias along a width thereof, as illustrated in FIG. 17. The insert 206 also preferably has an arced or curved bias from the tip 256 of the first portion 251 to the second end edge 267 of the second portion 253, the opposite end of the insert 206 as best illustrated in FIG. 18. This curved or arced bias is illustrated only in FIG. 18 and not in the other illustrations of the insert 206 solely or of the watch band construction 200 for ease in illustration purposes.

A plurality of holes 277 are provided through the fourth portion 257, the second portion 253, and the third portion 255 of the insert 206 to define an aperture wall 279. The plurality of holes 277 are distanced from one another a predetermined distance. The aperture wall 279 provided through the fourth portion 257 of the insert 206 are angled proximate to the first portion 251 of the insert 206 such that an angled aperture wall 281 is provided.

The buckle 208 of the watch band 200 is of a type well-known in the art and, therefore, will not be described in detail herein other than to denote a U-shaped portion 276, a pin 278, and a prong 280, as illustrated in FIG. 19. The keeper 210 of the watch band 200 is also of a type well-known in the art and, therefore, will not be described in detail.

Construction of the watch band 200 will now be discussed. The insert 206 is positioned or sandwiched between the top and bottom layers 202, 204 such that the third portion 255 is positioned within the die cut aperture 223 of the top layer 202, such that the fourth portion 257 is positioned within the die cut aperture 243 of the bottom layer 204, and such that the third side edge 259 of the first portion 251 of the insert 206 is positioned against the tip ends 214, 234 of the top and bottom layers 202, 204, respectively. When the insert 206 is positioned in such a manner, the second portion 253 or stitching shelf of the insert 206 is provided between the bottom surface of the top layer 202 and the top surface 230 of the bottom layer 204. The top and bottom layers 202, 204 are then stitched to the second portion 253 of the insert 206 at 283. The stitching 283 is provided around the die cut apertures 223, 243 using a high tenacity thread 282, such that the insert 206 is secured to the top and bottom layers 202, 204. All sides of the insert 206 are flush with or even with all surfaces of the top and bottom layers 202, 204.

The top and bottom layers 202, 204 are then stitched to one another at 285. The stitching 285 is provided along the first side edges 218, 238 and the second side edges 220, 240 thereof from the first ends 214, 234 to the second ends 216, 236, using the high tenacity thread 282. The top and bottom layers 202, 204 are further stitched to the insert 206 proximate to the tip ends 214, 234 thereof.

The second ends 216, 236 of the top and bottom layers 202, 204 are then inserted through the keeper 210, which is hollow, and the keeper 210 is positioned proximate to the fold lines 224, 244, but distal to the second ends 216, 236.

The keeper 210 is then secured to the top and/or bottom layer 202, 204 by appropriate means, which are well-known in the art.

The buckle 208 is then secured to the top and bottom layers 202, 204 of the watch band 200 by inserting the prong 280 through the hole 246 of the bottom layer 204, and then through the hole 226 of the top layer 202. The pin 278 of the buckle 208 is provided along the bottom surface 232 of the bottom layer 204 proximate to the fold line 244 such that the U-shaped portion 276 of the buckle 208 extends around the first and second side edges 218, 220; 238, 240 of the top and bottom layers 202, 204 such that the prong 280 can be positioned against the U-shaped portion 276.

The fold-under overlay portions 228, 248 of the top and bottom layers 202, 204 are then folded along the fold lines 22, 224 of the top and bottom layers 202, 204 such that the bottom surface 232 of the bottom layer 204 at the second end 236 thereof is positioned against the bottom surface 232 of the bottom layer 204 proximate to where the keeper 210 is secured to the bottom layer 204, with the keeper 210 being closer to the fold line 244. The second ends 216, 236 of the top and bottom layers 202, 204 are then secured in place to the top and bottom layers 202, 204 proximate to the keeper 210, preferably by stitching a box stitch with the high tenacity thread 282.

Thus, the watch band 200 is provided. The watch band 200 provides improved durability without sacrificing comfort and styling. The resin insert 206 of the watch band 200 forms the holes 277 and the tip end 256, effectively eliminating all raw edges, and maximizing the durability of the band 200 in the high wear areas of the pointed tip 256 and holes 277. The resin or plastic like materials of the insert 206 are durable and long lasting, hold up well, and eliminate all fraying. The resin or plastic like material of the insert 206 facilitate ease of use as the prong 280 of the buckle 208 easily inserts through one of the holes 277 of the insert 206. To this effect, the angled aperture wall 281 of the holes 277 which is provided in the fourth portion 257 of the insert 206 proximate to the tip end 256 further assists the user in inserting the prong 280 of the buckle 208 through one of the holes 277 of the insert 206. There is no issue of the prong 280 getting hung up on loose threads during insertion. As the insert 206 is curved slightly both along a length of the insert 206 and along a width of the insert 206, an ergonomic radius follows the curve of the wrist when wearing. This bias in the molded resin inset facilitates ease of putting on the watch band 200 as well as comfort while wearing. The ergonomic curve also improves ease of use. The insert 206 creates a smooth, comfortable, non-obtrusive surface. The first portion 251 of the insert 206 also is provided with the plurality of raised portions 263 as the raised portions 263 allow for a user to grip the first portion 251 of the insert 206 when securing the watch to the user's wrist.

It should be noted that the configuration of the insert 206 and the top and bottom layers 202, 204 enhance the integrity of the stitching and assembly of the watch band construction 200 of the second embodiment of the invention over the integrity of the stitching and assembly of the watch band construction 100 of the first embodiment of the invention and, thus, the configuration of the insert 106 and the top and bottom layers 102, 104.

While preferred embodiments of the present invention are shown and described, it is envisioned that those skilled in the art may devise various modifications without departing from the spirit and scope of the foregoing description and the appended claims.

The invention claimed is:

1. A watch band comprising:

a top layer having first and second opposite ends;

a bottom layer having first and second opposite ends, said bottom layer being secured to said top layer;

a buckle having a prong, said buckle being secured to said top and bottom layers proximate to said second ends thereof; and an insert configured to be secured between said top and bottom layers proximate to said first ends thereof, said insert defining a first portion which extends outwardly from said first ends of said top and bottom layers, said insert defining a second portion having a plurality of holes provided therethrough along a length thereof for receiving and securing said prong of said buckle, said insert being formed of a material which is stronger and more durable than materials of which said top and bottom layers are formed;

wherein said top and bottom layers have an aperture provided therethrough proximate to said first ends thereof, said second portion of said insert being positioned within said apertures of said top and bottom layers.

2. A watch band as defined in claim 1, wherein said material of said insert is a resin, wherein said material of said top layer is nylon, and wherein said material of said bottom layer is polyester.

3. A watch band as defined in claim 1, wherein said insert has a curved bias along a width thereof.

4. A watch band as defined in claim 1, wherein said insert has a curved bias along a length thereof.

5. A watch band as defined in claim 1, wherein each of said plurality of holes provided through said second portion of said insert defines an angled wall proximate to said bottom layer, said angled walls of said plurality of holes assisting in said prong of said buckle being received and secured within said plurality of holes.

6. A watch band as defined in claim 1, wherein said first portion of said insert has at least one raised portion extending from a bottom side thereof.

7. A watch band as defined in claim 1, wherein said top and bottom layers have an aperture provided therethrough which is open to said first ends of said top and bottom layers.

8. A watch band as defined in claim 1, wherein said top and bottom layers are secured to one another by stitching.

9. A watch band as defined in claim 1, wherein said insert is secured to said top and bottom layers by stitching.

10. A watch band comprising:

a top layer having first and second opposite ends and an aperture provided therethrough which is open to said first end of said top layer;

a bottom layer having first and second opposite ends and an aperture provided therethrough which is open to said first end of said bottom layer, said top layer being configured to overlie said bottom layer such that said apertures of said top and bottom layers overlie one another;

a buckle having a prong, said buckle being secured to said top and bottom layers proximate to said second ends thereof; and an insert having first and second portions, said first portion including a tip portion and a band hole portion, said tip portion extending outwardly from said first ends of said top and bottom layers away from said second ends of said top and bottom layers, said band hole portion being positioned within said apertures of said top and bottom layers, said band hole portion defining a plurality of holes therethrough along a length thereof for receiving and securing said prong of said buckle, said band hole portion further defining a top portion, a bottom portion and a middle portion provided between said top and bottom portions, said top portion being positioned within said aperture of said top layer and said bottom portion being positioned within said aperture of said bottom layer, said second portion being configured to be positioned between said top and bottom layers and secured to said top and bottom layers in order to secure said insert between said top and bottom layers.

11. A watch band as defined in claim 10, wherein said insert is formed of a material which is stronger and more durable than materials of which said top and bottom layers are formed.

12. A watch band as defined in claim 11, wherein said material of said insert is resin, wherein said material of said top layer is nylon, and wherein said material of said bottom layer is polyester.

13. A watch band as defined in claim 10, wherein said top layer, said bottom layer and said second portion of said insert are secured to one another by stitching.

14. A watch band as defined in claim 10, wherein said top and bottom layers are secured to one another along edges thereof by stitching.

15. A watch band as defined in claim 10, wherein said insert has a curved bias along a width thereof.

16. A watch band as defined in claim 10, wherein said insert has a curved bias along a length thereof.

17. A watch band as defined in claim 10, wherein said top and bottom layers each have a fold line provided proximate to said second ends thereof and a hole provided through said fold lines, said fold lines define fold-under overlap portions of said top and bottom layers at said second ends thereof, said holes provided through said fold lines configured to receive said prong of said buckle and said fold-under overlap portions configured to be folded under said bottom layer and secured to said top and bottom layers by stitching, such that said buckle is secured to said top and bottom layers.

18. A watch band comprising:

a top layer having first and second opposite ends and an aperture provided therethrough proximate to said first end of said top layer;

a bottom layer having first and second opposite ends and an aperture provided therethrough proximate to said first end of said bottom layer, said top layer being configured to overlie said bottom layer such that said apertures of said top and bottom layers overlie one another;

a buckle having a prong, said buckle being secured to said top and bottom layers proximate to said second ends thereof; and an insert having first and second portions, said first portion extending outwardly from said first ends of said top and bottom layers away from said second ends of said top and bottom layers, said second portion being at least partially positioned within said apertures of said top and bottom layers, said second portion defining a plurality of holes therethrough along a length thereof for receiving and securing said prong of said buckle, said second portion further being configured to be positioned between said top and bottom layers and secured to said top and bottom layers in order to secure said insert between said top and bottom layers, said second portion of said insert defines a top portion, a bottom portion and a middle portion provided between said top and bottom portions, said top portion being positioned within said aperture of said top layer and said bottom portion being positioned within said aperture of said bottom layer.

19. A watch band as defined in claim 18, wherein said insert is formed of a material which is stronger and more durable than materials of which said top and bottom layers are formed.

20. A watch band as defined in claim 19, wherein said material of said insert is resin, wherein said material of said top layer is nylon, and wherein said material of said bottom layer is polyester.

21. A watch band as defined in claim 18, wherein said top and bottom layers are secured to one another along edges thereof by stitching.

22. A watch band as defined in claim 18, wherein said top layers said bottom layer and said middle portion of said second portion of said insert are secured to one another by stitching.

23. A watch band as defined in claim 18, wherein each of said plurality of holes provided through said second portion of said insert define an angled wall in said bottom portion of said second portion of said insert, said angled walls of said plurality of holes assisting in said prong of said buckle being received and secured within said plurality of holes.

24. A watch band as defined in claim 18, wherein said insert has a curved bias along a width thereof.

25. A watch band as defined in claim 18, wherein said insert has a curved bias along a length thereof.

26. A watch band as defined in claim 18, wherein said first portion of said insert has at least one raised portion extending from a bottom side thereof.

27. A watch band as defined in claim 18, wherein said top and bottom layers each have a fold line provided proximate to said second ends thereof and a hole provided through said fold lines, said fold lines define fold-under overlap portions of said top and bottom layers at said second ends thereof, said holes provided through said fold lines configured to receive said prong of said buckle and said fold-under overlap portions configured to be folded under said bottom layer and secured to said top and bottom layers by stitching, such that said buckle is secured to said top and bottom layers.

* * * * *

UNITED STATES PATENT AND TRADEMARK OFFICE

CERTIFICATE OF CORRECTION

PATENT NO. : 7,275,667 B2
APPLICATION NO. : 10/858225
DATED : October 2, 2007
INVENTOR(S) : Bertucci It is certified that error appears in the above-identified patent and that said Letters Patent is hereby corrected as shown below:

Delete Title page illustrating a figure(s), and substitute therefor, new Title page illustrating a figure(s). (attached)

Delete drawing sheets 1-6, and substitute therefor drawing sheets 1-8. (attached)

Signed and Sealed this

Fourth Day of December, 2007

JON W. DUDAS
*Director of the United States Patent and Trademark Office*

(12) United States Patent
Bertucci

(10) Patent No.: US 7,275,667 B2
(45) Date of Patent: Oct. 2, 2007

(54) WATCH BAND CONSTRUCTION

(76) Inventor: Michael H. Bertucci, 991 Charles Ave., Gurnee, IL (US) 60031

( * ) Notice: Subject to any disclaimer, the term of this patent is extended or adjusted under 35 U.S.C. 154(b) by 485 days.

(21) Appl. No.: 10/858,225

(22) Filed: Jun. 1, 2004

(65) Prior Publication Data

US 2004/0245299 A1 Dec. 9, 2004

Related U.S. Application Data

(60) Provisional application No. 60/475,764, filed on Jun. 4, 2003.

(51) Int. Cl.
*A44B 1/04* (2006.01)
*A44B 11/25* (2006.01)

(52) U.S. Cl. ..... 224/178; 224/179; 2/338

(58) Field of Classification Search ..... 224/164–180, 224/219, 222, 267; 2/170, 338, 322; 24/265 WS, 24/178, DIG. 43; D10/32; D11/3
See application file for complete search history.

(56) References Cited

U.S. PATENT DOCUMENTS 1,234,165 A * 7/1917 Hill ..... 2/322
2,420,435 A * 5/1947 Lackow ..... 224/164
2,573,055 A * 10/1951 Pedersen ..... 224/178
2,585,457 A * 2/1952 Epstein ..... 2/322
3,578,208 A * 5/1971 Herzog ..... 224/178
5,212,966 A * 5/1993 Minami ..... 63/3
5,873,133 A * 2/1999 Junga et al. ..... 2/322
6,108,822 A * 8/2000 Calagui ..... 2/338
6,339,848 B1 * 1/2002 Mayhood et al. ..... 2/338
6,553,633 B1 * 4/2003 Rantala ..... 24/265 WS

* cited by examiner

*Primary Examiner*—Nathan J. Newhouse
*Assistant Examiner*—Corey N Skurdal
(74) *Attorney, Agent, or Firm*—Trexler, Bushnell, Giangiorgi, Blackstone & Marr, Ltd

(57) ABSTRACT

The present invention provides a watch band construction which includes a top layer, a bottom layer and an insert. The top and bottom layers each have an aperture provided proximate to the tip ends thereof. The insert is positioned between the top and bottom layers within the apertures and is stitched to the top and bottom layers to secure the insert between the top and bottom layers. The insert provides the tip for the watch band, as well as the holes through which the buckle prong extends. The tip may be formed with raised portions and the holes may be formed with angled walls at the bottom of the insert. The insert is formed with a curve bias along both a length and width thereof. The insert is formed of a sturdy material, such as resin, such that it is durable and long lasting in the areas of high wear.

27 Claims, 6 Drawing Sheets

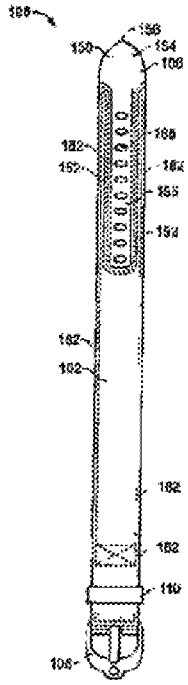

UNITED STATES PATENT AND TRADEMARK OFFICE

CERTIFICATE OF CORRECTION

PATENT NO. : 7,275,667 B2
APPLICATION NO. : 10/858225
DATED : October 2, 2007
INVENTOR(S) : Bertucci It is certified that error appears in the above-identified patent and that said Letters Patent is hereby corrected as shown below:

Delete Title page illustrating a figure(s), and substitute therefor, new Title page illustrating a figure(s). (attached)

Delete drawing sheets 1-6, and substitute therefor drawing sheets 1-8. (attached)

This certificate supersedes the Certificate of Correction issued December 4, 2007.

Signed and Sealed this

Eighteenth Day of August, 2009

David J. Kappos

David J. Kappos
*Director of the United States Patent and Trademark Office*

(12) United States Patent
Bertucci

(10) Patent No.: US 7,275,667 B2
(45) Date of Patent: Oct. 2, 2007

(54) WATCH BAND CONSTRUCTION

(76) Inventor: Michael H. Bertucci, 991 Charles Ave., Gurnee, IL (US) 60031

( * ) Notice: Subject to any disclaimer, the term of this patent is extended or adjusted under 35 U.S.C. 154(b) by 485 days.

(21) Appl. No.: 10/858,225

(22) Filed: Jun. 1, 2004

(65) Prior Publication Data

US 2004/0245299 A1 Dec. 9, 2004

Related U.S. Application Data

(60) Provisional application No. 60/475,764, filed on Jun. 4, 2003.

(51) Int. Cl.
*A44B 1/04* (2006.01)
*A44B 11/25* (2006.01)

(52) U.S. Cl. ..... 224/178; 224/179; 2/338

(58) Field of Classification Search ..... 224/164–180, 224/219, 222, 267; 2/170, 338, 322; 24/265 WS, 24/178, DIG. 43; D10/32; D11/3
See application file for complete search history.

(56) References Cited

U.S. PATENT DOCUMENTS 1,234,165 A * 7/1917 Hill ..... 2/322
2,420,435 A * 5/1947 Lackow ..... 224/164
2,573,055 A * 10/1951 Pedersen ..... 224/178
2,586,457 A * 2/1952 Epstein ..... 2/322
3,578,208 A * 5/1971 Herzog ..... 224/178
5,212,966 A * 5/1993 Minami ..... 63/3
5,873,133 A * 2/1999 Jurga et al. ..... 2/322
6,108,822 A * 8/2000 Calagui ..... 2/338
6,339,848 B1 * 1/2002 Mayhood et al. ..... 2/338
6,553,633 B1 * 4/2003 Rantala ..... 24/265 WS

* cited by examiner

*Primary Examiner*—Nathan J. Newhouse
*Assistant Examiner*—Corey N Skurdal
(74) *Attorney, Agent, or Firm*—Trexler, Bushnell, Giangiorgi, Blackstone & Marr, Ltd

(57) ABSTRACT

The present invention provides a watch band construction which includes a top layer, a bottom layer and an insert. The top and bottom layers each have an aperture provided proximate to the tip ends thereof. The insert is positioned between the top and bottom layers within the apertures and is stitched to the top and bottom layers to secure the insert between the top and bottom layers. The insert provides the tip for the watch band, as well as the holes through which the buckle prong extends. The tip may be formed with raised portions and the holes may be formed with angled walls at the bottom of the insert. The insert is formed with a curve bias along both a length and width thereof. The insert is formed of a sturdy material, such as resin, such that it is durable and long lasting in the areas of high wear.

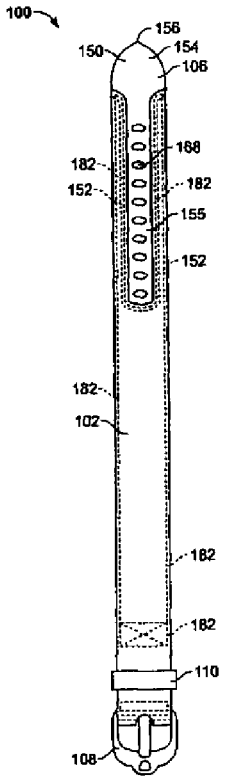

27 Claims, 8 Drawing Sheets